US007527345B2

(12) United States Patent
Fukuda et al.

(10) Patent No.: US 7,527,345 B2
(45) Date of Patent: May 5, 2009

(54) PRINT CONTROLLER, METHOD AND PROGRAM FOR PRINT CONTROL, COLOR CONVERSION TABLE, AND METHOD FOR DETERMINING INK QUANTITY

(75) Inventors: Takayuki Fukuda, Nagano (JP); Yoshifumi Arai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 595 days.

(21) Appl. No.: 10/870,408

(22) Filed: Jun. 16, 2004

(65) Prior Publication Data

US 2005/0024399 A1 Feb. 3, 2005

(30) Foreign Application Priority Data

Jun. 16, 2003 (JP) ..... 2003-170877
Jun. 16, 2003 (JP) ..... 2003-170878

(51) Int. Cl.
*B41J 29/38* (2006.01)
*B41J 29/393* (2006.01)
*B41J 2/17* (2006.01)
*B41J 2/01* (2006.01)

(52) U.S. Cl. ..... 347/9; 347/19; 347/98; 347/103

(58) Field of Classification Search ..... 347/19, 347/103, 9, 98
See application file for complete search history.

(56) References Cited

U.S. PATENT DOCUMENTS 6,471,347 B1 * 10/2002 Koitabashi et al. ..... 347/98
6,517,181 B2 * 2/2003 Yamamoto ..... 347/19
6,932,469 B2 * 8/2005 May et al. ..... 347/103
2001/0048530 A1 * 12/2001 Hayashi et al. ..... 358/1.13

FOREIGN PATENT DOCUMENTS

JP 08-60059 3/1996

OTHER PUBLICATIONS

Abstract of Japanese Patent Publication No. 08-60059, Pub. Date: Mar. 5, 1996, Patent Abstracts of Japan.

* cited by examiner

*Primary Examiner*—K. Feggins
*Assistant Examiner*—Jannelle M Lebron
(74) *Attorney, Agent, or Firm*—Martine Penilla & Gencarella, LLP

(57) ABSTRACT

When colored inks and a clear ink are recorded, the printing medium tends to undulate and blotting of ink can occur. Thus, it is difficult to obtain favorable picture quality under various printing conditions. To cope with this, a printing device is designed so that colored inks and a clear ink are recorded on a printing medium and an image thereby formed is controlled. The maximum recording rate for the colored inks is made lower than the maximum ink recording rate at which ink can be recorded per unit area of a printing medium. The quantities of inks are determined so that the clear ink and the colored inks are recorded on the printing medium with the maximum ink recording rate at which ink can be recorded per unit area of the printing medium taken as the limit. The image is formed with the thus determined ink quantities.

3 Claims, 11 Drawing Sheets

A>B $\alpha < \beta$ a~b

PRINT CONTROLLER, METHOD AND PROGRAM FOR PRINT CONTROL, COLOR CONVERSION TABLE, AND METHOD FOR DETERMINING INK QUANTITY

BACKGROUND OF THE INVENTION

1. Field of the Invention

The present invention relates to a print controller, a method and a program for print control, a color conversion table, and a method for determining ink quantity.

2. Description of the Prior Art

With respect to images formed in a printing device, their picture quality largely varies depending on the type of printing media. Therefore, when printing an image, users often choose printing media according to their purpose. There are a large number of variations of printing media. For example, there are media different in gloss, calendered paper and plain paper. Users choose calendered paper for high-picture quality printing of photos or the like, and use plain paper when they do not need the highest picture quality. The plain paper is prone to absorb ink recorded on its surface, and may not give desired color development. For example, ink can be excessively absorbed, and the surface of paper can be exposed.

If much ink is recorded, the calendered paper looks highly glossy. If the quantity of ink recorded is small, the paper is less prone to look glossy, and unevenness can show up in gloss depending on the ink quantity.

Conventionally, clear ink containing no coloring material, disclosed in Japanese Patent Prepublication No. Hei 8(1996)-60059, has been used together with colored ink.

With conventional technologies, clear ink is recorded together with colored ink. Therefore, printing media are prone to be undulated, and ink is prone to blot on printing media.

To cope with this, for printing devices, the upper limit of ink recording rate at which ink can be recorded per unit area is laid down from the various points of view: prevention of undulation in printing media, prevention of blotting of ink, reduction of grainy appearance, prevention of banding, and the like.

However, if clear ink is recorded at a constant ratio to colored ink, a problem arises. When the ink recording rate is high, undulation in the printing medium or blotting of the ink result. No matter how clear ink is recorded, undulation in printing media or blotting of ink occurs if the clear ink is simply recorded with no consideration given on the high ink recording rate side.

In case of calendered paper, the improvement of picture quality is expected by recording clear ink in an area where the colored ink is low in ink quantity. However, with respect to actual printing devices, there are a lot of printing conditions because they are provided with various modes and for other reasons. It used to be difficult to obtain favorable picture quality under various printing conditions simply by prescribing the quantity of clear ink.

More specific description will be given. When a plurality of images are printed under a plurality of printing conditions by a conventional technology, even an area with a small ink quantity is indeed glossy and the picture quality is improved in each image. But, when a plurality of the images are compared, they are different in gloss from one another, and impressions individual images give cannot be unified. Therefore, it is difficult to obtain favorable picture quality in every image.

SUMMARY OF THE INVENTION

The present inventors proposed an invention for stably improving picture quality in Japanese Patent Publication No. 2003-66997. Further, the prevent inventors made the present invention to solve the above-mentioned problems associated with prior art. That is, the object of the present invention is to provide a print controller, a method and a program for print control, a color conversion table, and a method for determining ink quantity wherein undulation in printing media and blotting of ink are prevented, and printed matter of high picture quality can be obtained under different printing conditions.

For the prevention of undulation in printing media and blotting of ink, one of the above-mentioned problems, an embodiment of the present invention is constituted as follows: with clear ink and colored ink combined, the maximum ink recording rate at which ink can be recorded per unit area of a printing medium is taken as the upper limit of ink recording rate. To perform print operation within this limit of ink recording rate, the present invention is so constituted that: when ink quantities are determined before performing print operation, the maximum recording rate for colored ink is reduced to a value smaller than the maximum ink recording rate at which ink can be recorded per unit area of the printing medium. Then, the clear ink and the colored ink are recorded on the printing medium with that maximum ink recording rate taken as the limit.

With this constitution, the maximum ink recording rate at which ink can be recorded per unit area of printing media is not exceeded with the clear ink and the colored ink combined. Therefore, undulation in printing media and blotting of ink can be prevented. When the maximum recording rate for colored ink is higher, the difference between the gradation obtained when no colored ink is recorded and that obtained when color ink is recorded at the maximum is increased. This can provide rich gray-scale expression. In the present invention, however, the maximum recording rate for colored ink is daringly reduced to a value smaller than the maximum ink recording rate at which ink can be recorded per unit area of printing media. Therefore, with both clear ink and colored ink recorded, the maximum recording rate can be prevented from being exceeded.

The present invention is intended to prevent undulation in printing media and blotting of ink. Therefore, the maximum ink recording rate at which ink can be recorded per unit area of printing media only has to be a maximum ink recording rate at which undulation in printing media and blotting of ink can be prevented. Needless to add, however, that may be a maximum ink recording rate with other points of view, that is, reduction of grainy appearance and prevention of banding taken into account.

The colored ink herein referred to only has to be ink which has colored coloring material contained in a solvent and looks colored when recorded on a printing medium. The clear ink only has to be ink which allows colored ink's property of color development to be improved. For example, a clear and colorless ink may be adopted as the clear ink because it has the same gloss as the colored ink and does not contain coloring material. More specifically, the ink disclosed in Japanese Patent Prepublication No. Hei 8(1996)-60059 or the like may be used for this purpose. With these inks, uneven color development can be reduced in plain paper, and water resistance and light resistance can be enhanced. Further, the gamut (color gamut) of colors which can rendered by combinations of clear ink and colored ink can be widened.

The recording rate for colored ink only has to be values which indicate the amounts of inks recorded per unit area. This includes cases where the colors of pixels are rendered by combinations of colored inks in a plurality of colors used in a printing device. Usually, the colors handled in a computer are rendered with a gradation with respect to each color component. Therefore, it can be said that a gradation value of 0 through the maximum gradation value correspond to ink recording rates of 0 to 100% with respect to each color. If 0 to 100% is taken for the ink recording rate for each color, needless to add, the upper limit of ink recording rate with all the colors included exceeds 100% in a printing device loaded with a plurality of color ink cartridges. The ink recording rate for colored ink and the like may be considered with 100% exceeded, or the upper limit with all the inks included may be standardized as a specific value. In any case, the ink recording rate only has to be an index which makes it possible to evaluate the quantities of inks recorded on a printing medium by integrating the quantities of recorded inks in respective colors.

An ink quantity determining unit only has to be capable of the following: the quantities of inks are determined so that colored ink and clear ink can be recorded on a printing medium with the maximum ink recording rate at which ink can be recorded per unit area of the printing medium taken as the limit; thereby, inks are prevented from being excessively recorded at a high ink recording rate. Various constitutions are available for this purpose. For example, the purpose can be accomplished by gradually reducing the recording rate for the clear ink with increase in ink recording rate in a predetermined range in which the ink recording rate exceeds a predetermined value.

More specific description will be given. In the present invention, color development in plain paper is enhanced by recording clear ink together with colored ink. Therefore, it is preferable that a finite quantity of clear ink should be used at every ink recording rate. However, if clear ink is recorded so that its ratio to colored ink will be constant over a range from low ink recording rate to high ink recording rate, a problem arises. The problem occurs if an attempt is made not to exceed the maximum ink recording rate at which ink can be recorded per unit area of printing media with respect to both colored ink and clear ink: at this time, the maximum recording rate for colored ink largely falls away from the maximum ink recording rate at which ink can be recorded per unit area of printing media. In this case, the gradation value range of the recording rate for colored ink is narrowed, and the gradation property is degraded.

To cope with this, the following constitution is adopted: even if clear ink is recorded so that its ratio to colored ink is constant over a range from low ink recording rate to high ink recording rate, the following procedure is taken: the recording rate for the clear ink is gradually reduced with increase in ink recording rate in a predetermined range in which the ink recording rate exceeds a predetermined value. With this constitution, the quantity of clear ink consumed is gradually reduced in the high ink recording rate range in which the ink recording rate exceeds the predetermined value. However, reduction in the maximum recording rate for colored ink can be prevented, and thus degradation in gradation property can be prevented. To determine ink quantities for an image to be printed, various constitutions can be adopted. One example is such that: image data wherein the colors of an image to be printed are represented in a specific color system is created. The color system of the image data is converted into a color system in which colors are represented with inks used in a printing device, using a predetermined color conversion table. At this time, the ink quantities of colored ink and clear ink are determined. Needless to add, other constitutions than that using a color conversion table may be adopted. For example, color conversion may be carried out using a profile wherein both the color systems are brought into correspondence with each other by functions.

Needless to add, the present invention can be implemented even if an ink quantity determining unit or a print controlling unit is not provided.

Further, various constitutions can be adopted to prevent undulation in printing media and blotting of ink. One example is such that: the quantities of inks are determined so that colored ink and clear ink are recorded on a printing medium. At this time, for ink droplets different in discharge quantity, the value of a predetermined ratio which indicates the quantity of clear ink relative to a predetermined standard is made to differ.

More specific description will be given. A constitution wherein a ratio to a predetermined standard is predetermined and the quantity of clear ink is determined poses a problem. If a common ratio is applied to ink droplets different in the discharge quantity of colored ink, clear ink is increased in quantity relative to colored ink for ink droplets large in discharge quantity; and clear ink is reduced in quantity relative to colored ink for ink droplets small in discharge quantity. The appropriate quantity of clear ink is not always in proportion to the discharge quantity of colored ink. If the quantity of clear ink is increased or decreased in proportion to increase or decrease in colored ink, rather undulation in printing media or blotting of ink is prone to occur.

However, this can be coped with by making the predetermined ratio indicating the quantity of clear ink differ from ink droplet to ink droplet different in discharge quantity. Thus, the quantity of clear ink can be appropriately adjusted with respect to each of ink droplets different in discharge quantity. As a result, undulation in printing media and blotting of ink can be prevented without fail with respect to each of ink droplets different in discharge quantity. Various constitutions can be adopted for the predetermined ratio. It may be the ratio to the ink quantity of colored ink or the ratio to the ink quantity which can be recorded per unit area. In the former case, the ink quantity of colored ink is taken for the predetermined standard, and in the latter case, the ink quantity which can be recorded per unit area of printing media is taken for the predetermined standard.

Various situations in which ink droplets are different in discharge quantity are possible. In an ink jet printer, for example, the discharge quantity can be made to differ by varying the magnitude of force exerted when ink is discharged from the head. To vary the magnitude of force exerted when ink is discharged, various constitutions can be adopted. Examples include the following constitutions: a constitution wherein large, medium, and small ink droplets can be discharged for one pixel; and a constitution wherein the discharge quantity of ink droplets for each time is changed according to print mode (e.g. resolution).

In the above example, the discharge quantity of ink droplet is changed in a single printing device. Further, the present invention can be applied to cases where the discharge quantity of ink droplet for each time is different in different printing devices. An example will be taken. The discharge quantity of ink droplet for each time is changed sometimes in printing devices of different models even if they are equally of ink jet drive system. The present invention is also applicable to this case. Thus, in any model, undulation in printing media and blotting of ink can be prevented while necessary and sufficient quantities of clear ink are used.

Further constitutions can be adopted to change the quantity of clear ink with respect to each discharge quantity of ink droplet. One example is a constitution wherein the predetermined ratio to ink droplets large in discharge quantity is made lower than that to ink droplets smaller in discharge quantity. With this constitution, an unnecessarily large quantity of clear ink is prevented from being recorded with respect to an ink droplet large in discharge quantity. Thus, undulation in printing media and blotting of ink can be prevented with ease.

Further, the following constitution may be adopted: when the quantity of clear ink is specified at a predetermined ratio, the predetermined ratio is made to differ, and thereby the quantities of clear ink are made substantially equal with respect to ink droplets different in discharge quantity. More specific description will be given. If clear ink is recorded together with colored ink, the color development can be enhanced. However, the color development is not further enhanced when the quantity of clear ink is increased. When clear ink is recorded to some extent, its effect remains about the same even if the discharge quantity of ink droplet is varied, and the color development can be similarly enhanced. Consequently, the quantity of clear ink is made substantially equal with respect to ink droplets different in discharge quantity. Thus, the color development can be enhanced to the necessary and sufficient extent with respect to each of the ink droplets different in discharge quantity. Further, clear ink is prevented from being recorded more than necessary, and both the enhancement of color development and the prevention of undulation in printing media and blotting of ink can be simultaneously accomplished.

Various constitutions can be adopted to make the quantity of clear ink substantially equal with respect to ink droplets different in discharge quantity, as mentioned above. For example, the inverse ratio of the discharge quantity of each ink droplet may be made substantially equal to the ratio of the predetermined ratio to the ink droplet in each discharge quantity. With this constitution, the following takes place with respect to ink droplets different in discharge quantity: the predetermined ratio is relatively low with respect to those large in discharge quantity, and the predetermined ratio is relatively high with respect to those small in discharge quantity. Thus, the inverse ratio of discharge quantity and the ratio of the predetermined ratio are substantially identical. As a result, the quantities of clear ink for both are substantially equal to each other.

The predetermined ratio only has to be predetermined with respect to each of the ink droplets different in discharge quantity. The ratio may fluctuate according to increase or decrease in the number of ink droplets recorded per unit area. Even with this constitution, the quantity of clear ink can be appropriately adjusted with respect to each of ink droplets different in discharge quantity when the number of ink droplets recorded per unit area is the same from ink droplet to ink droplet different in discharge quantity. This can be accomplished as long as the above predetermined ratio is different.

As mentioned above, the technique for adjusting the quantity of clear ink recorded need not be a substantial apparatus, and the present invention is effective also as a methodological invention. The above-mentioned print controller may be solely implemented, or may be incorporated into some equipment when utilized. Thus, the philosophy of the present invention can be implemented in various embodiments, and the embodiments of the present invention can be modified as appropriate. For example, the present invention can be embodied also as software or hardware.

The philosophy of the invention can be embodied as software for a print controller. In this case, the present invention naturally exists on a recording medium with such software recorded thereon, and is utilized therein. Needless to add, the recording medium may be a magnetic recording medium or a magneto-optic recording medium, and this is the same with any recording medium that will be developed in the future. This is completely the same with the phases of reproduction, such as primary duplicate copies and secondary duplicate copies, completely without question. Needless to add, the present invention may be identified as an invention of program, as described with respect to some aspects of the present invention.

A further constitution of the present invention is possible. Common printing devices often perform print operation by following the steps of: acquiring first image data which indicates an object to be printed; and converting the data into second image data wherein colors are identified in correspondence with the quantities consumed of inks used in a printing device. With this constitution, color conversion is carried out by color conversion table, and a color conversion table may be constituted as an embodiment of the present invention. More specific description will be given. Color conversion is carried out by color conversion table so that: the recording rate for the clear ink is gradually reduced with increase in ink recording rate in a predetermined range in which the recording rate for ink recorded according to the second image data exceeds a predetermined value. By performing print operation based on this color conversion, the maximum ink recording rate of printing media can be prevented from be exceeded while clear ink is used.

Further, sometimes the recording rates for colored inks recorded according to the second image data based on different color conversion tables, that is, the ink recording rates determined by conversion are equal. In this case, color conversion tables are defined so that the recording rate for clear ink is varied. Thus, undulation in printing media and blotting of ink can be prevented without fail with respect to each of ink droplets different in discharge quantity.

Further, the present invention can be identified as a technique for determining ink quantities in a printing device. More specific description will be given. The discharge quantity of ink can be different from printing device to printing device. Or, the discharge quantity of ink can be different in one and the same model because of difference in print mode. In such a case, ink droplets different in diameter are discharged to ensure a lot of gradations. At this time, the above-mentioned predetermined ratio is varied with respect to ink droplets different in discharge quantity. Thus, undulation in printing media and blotting of ink can be prevented without fail in each case.

For the prevention of the inability to obtain printed matter of high picture quality under different printing conditions, one of the above-mentioned problems, an embodiment of the present invention is constituted as follows: the predetermined ratio which defines the quantity of clear ink is made to differ from printing condition to printing condition. More specific description will be given. The quantity of clear ink is defined so that its ratio becomes a predetermined value relative to a predetermined standard. At this time, the ratio is varied from printing condition to printing condition. Thus, a favorable quantity of clear ink can be recorded under each printing condition. As a result, when print operation is performed under different printing conditions, printed matter of high picture quality can be obtained under every printing condition. Further, the picture quality and the appearance of colors can be unified among pieces of printed matter printed under different printing conditions.

In terms of reduction of uneven gloss, it is preferable that a relatively large quantity of clear ink should be recorded in an area where the quantity of colored ink recorded is small and the gloss is lower than the other areas only with the colored ink. If the recording rate for colored ink is equal to or below a predetermined value, the above-mentioned predetermined ratio should be defined so that the recording rate for clear ink is increased. Further, by adding gloss by clear ink, the gamut (color gamut) of colors which can be rendered by combinations of colored inks can be widened. Therefore, the picture quality is enhanced in this sense as well. Needless to add, that gloss differs according to printing conditions means that colors may differ when print operation is performed according to the same data. Therefore, the predetermined ratio should be preferably determined so as to record clear ink so that the appearance of colors is also unified when print operation is performed under different printing conditions.

The printing conditions include various conditions which must be set before print operation is performed with a printing device. For the present invention, the printing conditions only have to be conditions under which the following can be accomplished: when print operation is performed with respect to at least the same image data by specifying the quantities of clear ink at an equal ratio, gloss and the appearance of colors are different. Possible printing conditions include: print resolutions the printing device supports; the type of ink (e.g. color and monochrome); the type of printing media; print quality (e.g. beautiful, fast); the type of color management (e.g. the availability of automatic adjustment, the availability of colors beyond the color gamut in the display); the availability of bi-directional printing; and the like.

Needless to add, the above predetermined ratio may be varied when any of these conditions is different, or it may be varied when some of these conditions are different. If the gloss and the appearance of colors are common when compared under specific different conditions, the above predetermined ratio may be equalized. Various constitutions can be adopted for the predetermined ratio. It may be the ratio to the ink quantity of colored ink or the ratio to the ink quantity which can be recorded per unit area. In the former case, the ink quantity of colored ink is taken for the predetermined standard, and in the latter case, the ink quantity which can be recorded per unit area of printing media is taken for the predetermined standard.

An ink quantity determining unit only has to be capable of determining the quantities of inks recorded on printing media to form the image of an object to be printed. Various constitutions can be adopted for this purpose. One example is such that: image data wherein the colors of an image to be printed are represented in a specific color system is created. The color system of the image data is converted into a color system in which colors are specified with inks used in a printing device, using color conversion tables predetermined for individual printing conditions. At this time, the ink quantities of colored ink and clear ink are determined. Needless to add, other constitutions than that using color conversion tables may be adopted. For example, color conversion may be carried out using a profile wherein both the color systems are brought into correspondence with each other by functions.

The common printing device is so constituted that: it acquires a gradation value for each ink by color conversion and then performs half tone processing, and records inks at ink recording rates corresponding to the gradation values. Therefore, it can be said that the ink quantities are determined by acquiring a gradation value for each ink by color conversion. More specific description will be given. A gradation value of 0 through the maximum gradation value of each ink correspond to the ink recording rates of 0 through 100% for each color. In half tone processing, the quantity of ink consumed is determined with respect to each pixel so that the ink is recorded at the ink recording rate.

The following constitution can be adopted as a preferred embodiment of the ink quantity determining unit: the above predetermined ratio is made different from printing condition to printing condition of different print resolutions, and the quantity of clear ink is adjusted on a print resolution-by-print resolution basis. More specific description will be given. The number of pixels per unit area differs when the print resolution differs. Therefore, if the ink recording rate is identical with the resolution being different, the following takes place: if the ink quantity per pixel is equal with respect to each resolution, the area of the printing medium covered with ink in unit area largely differs.

If the area of printing media covered with ink differs at the same ink recording rate, the color differs as well. To cope with this, in general, the ink quantity per pixel is varied. Also, sometimes a different color conversion table is prepared beforehand with respect to each print resolution, and a different result of color conversion is obtained on a print resolution-by-print resolution basis. In any case, when the print resolution is different, the quantity of colored ink used to print the same image data is different. Therefore, difference in gloss and color between print resolutions can be eliminated by taking the following procedure: if the print resolution is different, the predetermined ratio is varied to change the quantity of clear ink.

Further, the following can be adopted as a preferred embodiment of the ink quantity determining unit: If the area of printing media occupied by the colored ink in unit area differs from printing condition to printing condition, the predetermined ratio is varied, and the quantity of clear ink is adjusted according to the area occupied by the colored ink. More specific description will be given. Even if the same image data is printed, the area of printing media occupied by the colored ink in unit area can differ depending on printing conditions. In this case, the quantity of clear ink is adjusted. With this constitution, the differences in gloss and color between pieces of printed matter can be eliminated even if the area occupied by the colored ink in unit area of printing media differs from printing condition to printing condition.

There are various situations in which the area occupied by the colored ink in unit area of printing media differs from printing condition to printing condition. Examples include: cases where the ink quantity per pixel is different; cases where how ink adheres to a printing medium is different when the printing medium is different; cases where the viscosity of ink differs depending on the temperature and the humidity during print operation; cases where how ink adheres to a printing medium differs depending on the temperature and humidity of the printing medium; and the like.

Further, the following constitution can be adopted as a preferred embodiment of the ink quantity determining unit: if the weight of ink recorded per pixel differs from printing condition to printing condition, the predetermined ratio is varied, and the quantity of clear ink is adjusted according to the area occupied by the colored ink. More specific description will be given. Even if the same image data is printed, the weight of ink recorded per pixel can differ depending on printing conditions. In this case, the quantity of clear ink is adjusted. With this constitution, the differences in gloss and color between pieces of printed matter can be eliminated even if the weight of ink recorded per pixel differs from printing condition to printing condition. There are various situations in which the weight of ink recorded per pixel differs from printing condition to printing condition. An example is cases where in a head filled with ink, the force exerted on the ink when the ink is discharged differs.

When the predetermined ratio is varied depending on printing conditions, the following procedure may be taken: the predetermined ratio is determined in accordance with change in printing conditions. That is, with respect to a common printing condition item, the predetermined ratio is determined in accordance with the trend of change in the set value of that item. With this constitution, the quantity of clear ink can be easily determined in accordance with change in printing conditions. Further, the differences in gloss and color between pieces of printed matter can be eliminated under various printing conditions. With respect to the extent to which the predetermined ratio is varied according to printing conditions, the following constitutions can be adopted: the predetermined ratio is changed, that is, the quantity of clear ink consumed is changed, and trial print operation is performed under individual printing conditions. Thereby a ratio at which no difference is produced in gloss or color under each printing condition is found. Alternatively, with respect to gloss and color, correlation between pieces of printed matter due to printing conditions and the predetermined ratio is computed by trial print operation. Then, the predetermined ratio is determined according to the correlation.

As mentioned above, there are various printing conditions. Various constitutions can be adopted to judge how printing conditions are set. An example is such that: UI is displayed on a display unit before print operation is performed so that entry can be made with respect to printing condition items. Then, printing conditions established through entry by the user are acquired. With this constitution, all the printing conditions are established through entry by the user. However, for items which are not established by the user, default printing conditions may be utilized, or print operation may be performed under printing conditions all established by default. In these cases as well, printing conditions for print operation to be performed only have to be acquired.

The quantity of clear ink is adjusted by varying the predetermined ratio. As a preferred constitution for the predetermined ratio, the ratio of the clear ink which can be recorded per unit area to the maximum ink recording rate can be adopted. More specific description will be given. The maximum ink recording rate at which clear ink can be recorded per unit area is the upper limit of the quantity of clear ink recorded per unit area. By adjusting the quantity of the clear ink through the ratio thereto, the quantity of clear ink can be easily defined through comparison with the maximum ink recording rate. With respect to printing media, in general, the maximum ink recording rate at which ink can be recorded on a medium (the sum of the quantities of inks) is determined. Therefore, the above constitution is preferable in that comparison with the maximum ink recording rate at which ink can be recorded on the medium concerned is easy to carry out.

Further, with the constitution wherein the quantities of inks are determined by color conversion, as mentioned above, the ink recording rate for each ink is determined by gradation values obtained by color conversion, as mentioned above. Therefore, if such a constitution that the quantity of clear ink is determined also by the color conversion is adopted, the predetermined ratio can be easily determined by gradation values. Further, the ink quantity can be adjusted with ease.

When the predetermined ratio is the ratio of clear ink which can be recorded per unit area to the maximum ink recording rate, it is preferable that the following procedure should be taken: further, a ratio at which the recording rate for colored ink at which ink is recorded per unit area is a finite value within a range in which a predetermined value is not exceeded is taken for this ratio. More specific description will be given. The predetermined ratio related to clear ink is brought into correspondence with the recording rate for colored ink. The predetermined ratio related to clear ink is made finite at least within a range in which the recording rate of colored ink recorded per unit is equal to or below a predetermined value, and a finite quantity of clear ink is recorded.

As mentioned above, with respect to calendered paper, it is preferable that a relatively large quantity of clear ink should be recorded in an area where the recording rate for colored ink is low and the gloss is lower than the other areas only with the colored ink. By making finite the predetermined ratio related to clear ink within a range in which the recording rate of colored ink recorded per unit area is equal to or below a predetermined value, uneven gloss can be prevented with ease.

When the predetermined ratio related to clear ink is made finite within a range in which the recording rate of colored ink recorded per unit area is equal to or below a predetermined value, the following procedure is further taken: the predetermined ratio is varied so that the sum of the recording rate for colored ink and that for clear ink colored ink is substantially identical in a range in which the recording rate for colored ink is equal to or below a predetermined value. The gloss of printing media obtained by ink is determined by both colored ink and clear ink. When the sum of the ink recording rates of both is substantially identical in a range in which the recording rate for colored ink is equal to or below a predetermined value, the gloss becomes substantially constant in the range of value equal to or below the predetermined value. As a result, uneven gloss is prevented. According to the present invention, the following procedure is taken even if the sum of the recording rates for colored and clear inks is substantially identical in a range in which the recording rate for colored ink is equal to or blow a predetermined value: the predetermined value and the value of sum are changed from printing condition to printing condition. As a result, a difference in gloss can be prevented from being produced between printing conditions.

In the above description, the present invention is constituted so that the sum of the recording rates for colored and clear inks is substantially identical. Since the quantity of clear ink can be adjusted by adjusting the predetermined ratio, as mentioned above, various constitutions can be further adopted. More specific description will be given. There are cases where making fine adjustment with respect to each printing condition is preferable to making the sum of the recording rates substantially identical. In such cases, finer adjustment can be made by: varying the way the sum of the recording rates for colored ink and clear ink is gradually increased or decreased in a range in which the recording rate for colored ink is equal to or below a predetermined value; varying the value when the sum is fixed; or varying the predetermined value. Thus, uneven gloss can be eliminated even in the following cases: cases where uneven gloss is produced due to change in colored ink recording rate or cases where the way uneven gloss is produced is different from printing condition to printing condition.

As mentioned above, the technique for adjusting the predetermined ratio which defines the quantity of clear ink on a printing condition-by-printing condition basis need not be a substantial apparatus. The present invention is effective also as a methodological invention. Further, the above-mentioned print controller may be solely implemented, or may be incorporated into some equipment when utilized. Thus, the philosophy of the present invention can be implemented in various embodiments, and the embodiments of the present invention can be modified as appropriate. For example, the present invention can be embodied also as software or hardware.

The philosophy of the invention can be embodied as software for a print controller. In this case, the present invention naturally exists on a recording medium with such software recorded thereon, and is utilized therein. Needless to add, the recording medium may be a magnetic recording medium or a magneto-optic recording medium, and this is the same with any recording medium that will be developed in the future. This is completely the same with the phases of reproduction, such as primary duplicate copies and secondary duplicate copies, completely without question. Needless to add, the present invention may be identified as an invention of program.

Further, the present invention can be identified as a technique for determining the ink quantities in a printing device. More specific description will be given. Printing conditions can be different from printing device to printing device, and printing conditions can be different in one and the same model because of difference in print mode. In such a case, uneven gloss can be eliminated without fail by varying the predetermined ratio on a printing condition-by-printing condition basis.

DESCRIPTION OF THE PREFERRED EMBODIMENTS

Here, embodiments of the present invention will be described in the following order:

(1) First Embodiment (1-1) Configuration of Print Controller:
(1-2) Print Control Processing:
(1-3) Details of Ink Recording Rate:

(2) Details of Ink Recording Rate in Second Embodiment (3) Modifications to First and Second Embodiments (4) Third Embodiment (4-1) Print Controller:
(4-2) Print Control Processing:
(4-3) Details of Ink Recording Rate:

(5) Modification to Third Embodiment

(1) First Embodiment

Figure 1:
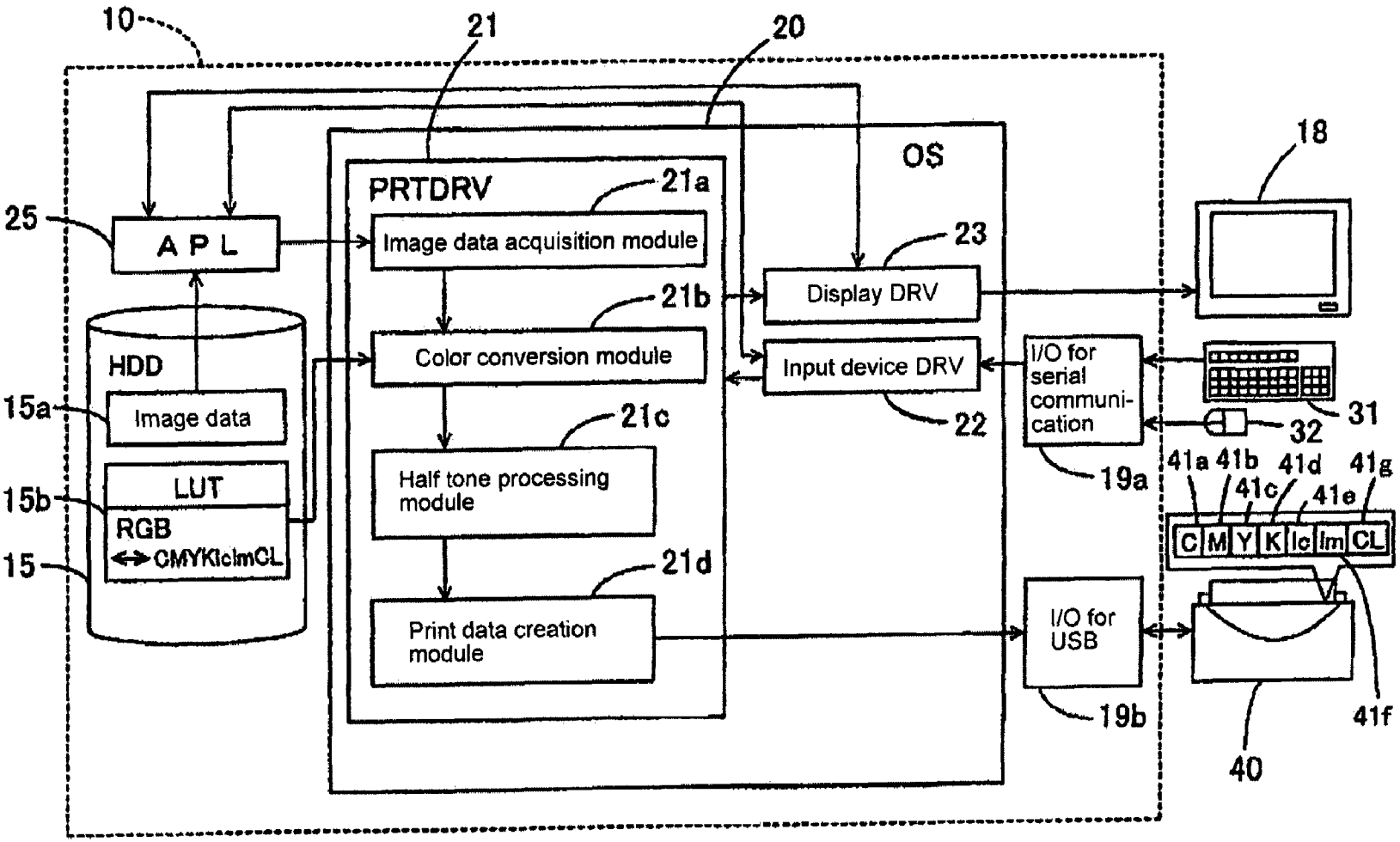
FIG. 1 is a drawing schematically illustrating the configuration of a computer as a print controller.

(1-1) Configuration of Print Controller:

FIG. 1 is a block diagram schematically illustrating the configuration of a computer as a print controller according to the present invention. The computer 10 comprises CPU (not shown) which serves as the nerve center of computation, ROM and RAM (not shown) as storage media, and the like. The computer 10 is capable of executing predetermined programs, utilizing peripheral devices, such as HDD 15. The computer 10 is connected with input devices for operation, such as keyboard 31 and mouse 32, through an I/O 19*a* for serial communication. It is also connected with a display 18 for indication through a video board (not shown). Further, the computer 10 is connected with a printer 40 through an I/O 19*b* for USB.

In this embodiment, the printer 40 is provided with a mechanism which makes it possible to load or unload ink cartridges filled with inks in a plurality of colors on a color-by-color basis. The mechanism is loaded with cartridges 41*a* to 41*g* for inks in C, M, Y, K, lc, lm, and CL (cyan, magenta, yellow, black, light cyan, light magenta, and clear ink). Each of the C, M, Y, K, lc, and lm inks is a colored ink which has colored coloring material mixed in a solvent, and develops the color of the coloring material when recorded on a printing medium. The printer 40 is capable of forming a large number of colors by combining theses colored inks, and forms images on printing media based on the capability.

The CL ink is an ink for enhancing the picture quality of images formed by these colored inks. In this embodiment, the CL ink has the same gloss as each colored ink does, and is colorless because no colored coloring material exists in the solvent. The CL ink is used together with colored inks, and is thereby capable of adding gloss to colored portions even in plain paper wherein printing media are prone to be impregnated with ink. Even in calendered paper, the CL ink is capable of adding gloss to areas which have small quantities of colored inks recorded and are thus less glossy, and of improving the color development. More specifically, the CL ink allows the gamut of colors which can be printed with the printer 40 to be widened as compared with cases where the CL ink is not used.

The advantages of the CL ink are not only addition of gloss and elimination of difference in gloss. When added to colored inks, the CL ink is capable of enhancing the water resistance and the light resistance as compared with cases where only colored inks are recorded. The printer 40 in this embodiment is a so-called ink jet printer, and is so constituted that force is exerted on inks in the head filled with the inks and thereby the inks are discharged. At this time, voltage may be applied to piezo elements to exert discharging force on the inks, or bubbles may be formed in the head to exert discharging force on the inks.

With respect to this embodiment, description will be given to cases where the discharge quantities of C, M, Y, K, lc, lm, and CL ink droplets are constant. Needless to add, however, the present invention can be applied to other various constitutions, such as a constitution wherein the discharge quantities of ink droplets are varied in three stages. Further, the present invention is applicable not only to the inkjet printer but also to other printers, such as laser printer. Further, the constitution wherein colored inks in six colors, C, M, Y, K, lc, and lm, illustrated in FIG. 1, are used is not indispensable. Other constitutions wherein four colors, C, M, Y, and K are used or seven colors, C, M, Y, K, lc, lm, and DY (dark yellow) are used may be adopted. Needless to add, other colors, for example, R (red) and V (violet) may be used in place of the lc and lm inks, or deep black ink or light black ink may be used as K ink.

The configuration of the computer 10 is simplified for the purpose of description, but those of ordinary configuration as personal computer can be used for the computer 10. Needless to add, the computer to which the present invention is applied is not limited to personal computer. This embodiment uses a so-called desktop computer, but a notebook computer or equipment which supports mobile computing may be used. Further, the connecting interface between the computer 10 and the printer 40 is not limited to the foregoing. Other various modes of connection, including parallel interface, SCSI connection, and wireless connection, can be used, and this is the same with any mode of connection that will be developed in the future.

In this embodiment, a print controller is constituted of the computer 10. However, other constitutions may be adopted. For example, print control processing according to the present invention can be performed in the program execution environment provided in the printer 40. Or, print control processing may be performed by acquiring image data from a digital camera connected directly to the printer 40. Needless to add, print control processing may be performed in a digital camera with the similar constitution, and other various constitutions can be adopted. For example, print control processing according to the present invention may be performed in a decentralized manner. The print control processing according to the present invention may be performed in a so-called multiple function machine wherein a scanner for capturing images and a printer for printing images are integrated with each other.

In the computer 10 in this embodiment, a printer driver (PRTDRV) 21, an input device driver (input device DRV) 22, and a display driver (display DRV) 23 are installed in OS 20. The display DRV 23 is a driver which controls the indication of image data and the like on the display 18. The input device DRV 22 is a driver which receives code signals from the keyboard 31 or the mouse 32, inputted through the I/O 19*a* for serial communication, and accepts predetermined input operation.

Symbol APL 25 denotes an application program which is capable of executing retouching of color images and the like. The user can cause the printer 40 to print the color images by operating the input devices for operation under the execution of the APL 25. More specific description will be given. In response to an instruction from the user, the APL 25 reads image data 15*a* recorded on the HDD 15 into the RAM, and causes the display 18 to show the image based on the image data 15*a* through the display DRV 23. When the user operates the input devices, the details of the operation are acquired through the input device DRV 22 and interpreted. The APL 25 performs varied processing, including instruction to print and retouching, according to the details of the operation.

The image data 15*a* is data in a dot matrix pattern wherein the color components of R, G, and B (red, green, and blue) are rendered with gradation and the color of each pixel is thereby defined. In this embodiment, the image data is so constituted that each color is rendered with a 256-step gradation, and a color system according to the sRGB standard is adopted. With respect to this embodiment, description will be give with this image data 15*a* taken as an example. However, other varied data can be adopted for the purpose. For example, JPEG image data which uses the YCbCr color system, image data which uses the CMYK color system, or the like can be adopted. Needless to add, the present invention can be applied to other data. Examples include: data in accordance with the Exif2.2 standard (Exif is a registered trademark of Japan Electronics and Information Technology Industries Association.), and data in accordance with Print Image Matching (PIM: PIM is a registered trademark of Seiko Epson Corporation.).

When the APL 25 provides an instruction to print, the PRTDRV 21 is driven, and the PRTDRV 21 sends data out to the display DRV 23. The display DRV 23 displays UI (not shown) for allowing the user to input information indicating printing conditions, such as printing media, picture quality, and print speed. When the user operates the keyboard 31, mouse 32, or the like and inputs information required for print operation at the UI, the modules of the PRTDRV 21 are started. With respect to each pixel data in the image data 15*a*, processing is performed by the modules, and print data is created. The created print data is outputted to the printer 40 through the I/O 19*b* for USB, and the printer 40 performs print operation according to the print data.

Figure 2:
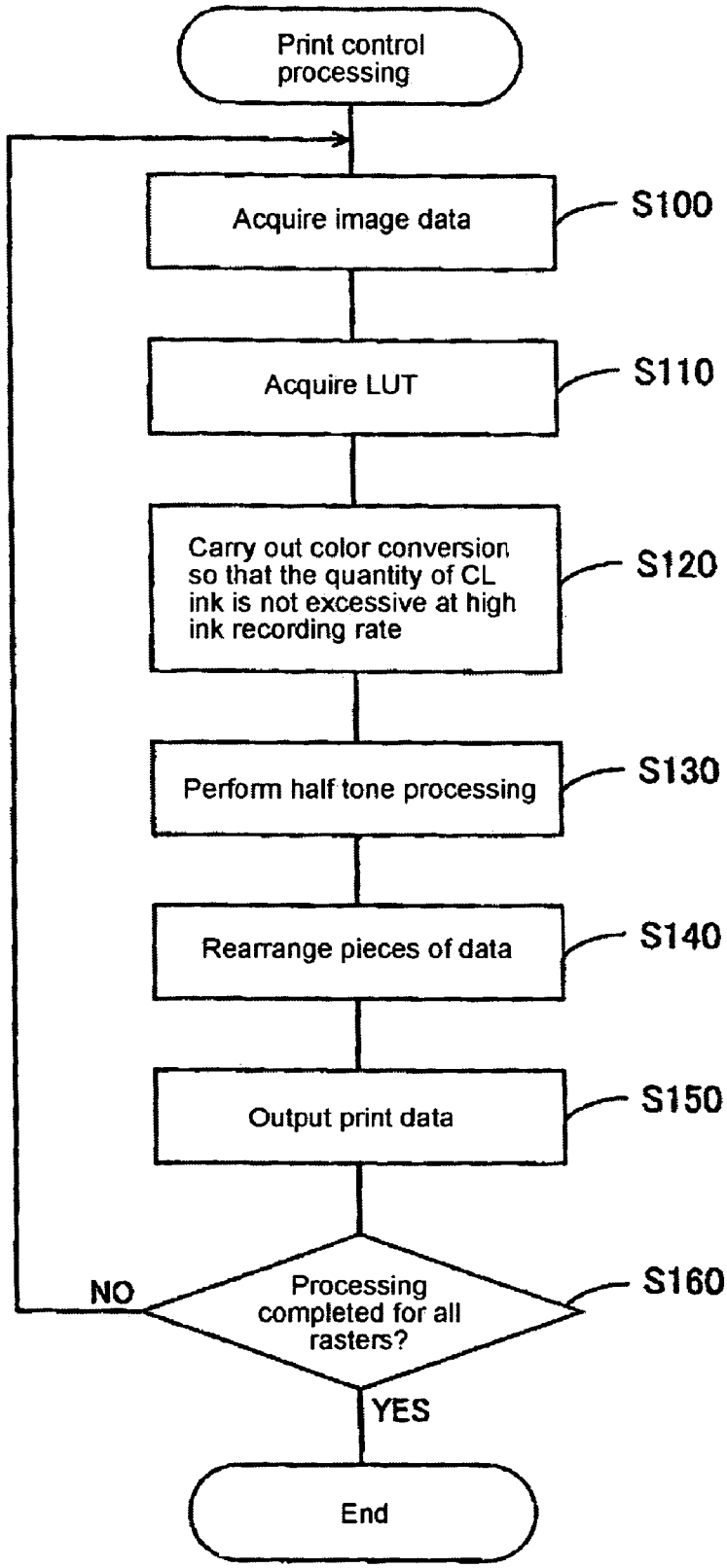
FIG. 2 is a flowchart of the print control processing in a second embodiment.

(1-2) Print Control Processing:

More specifically, to perform print operation, the PRTDRV 21 comprises an image data acquisition module 21*a*, a color conversion module 21*b*, a half tone processing module 21*c*, and a print data creation module 21*d*. The PRTDRV 21 performs print control processing in accordance with the flow illustrated in FIG. 2. When the APL 25 reads the image data 15*a* and after retouching or the like, provides an instruction to print, the PRTDRV 21 is started. At Step 100, the image data acquisition module 21*a* acquires the image data 15*a* indicating the image for which the instruction to print is provided by the APL 25. If there is any excess or deficiency in the number of pixels in the image data 15*a* at this time, resolution conversion processing is performed as required to ensure pixels required for the print operation.

The color conversion module 21*b* is a module which converts color systems in which the color of each pixel is indicated. The module 21*b* refers to LUT (color conversion table) 15*b* recorded on the HDD 15 as required, and carries out conversion. At this time, the sRGB color system of the image data 15*a* is converted into the CMYKlclmCL color system whose components are the inks (C, M, Y, K, lc, lm, and CL) loaded in the printer 40. It is C, M, Y, K, lc, and lm inks that actually develops colors. However, the color development on printing media varies depending on whether the CL ink is recorded or not. Though the CL ink is colorless, therefore, color conversion is carried out into the CMYKlclmCL color system including CL.

The LUT 15*b* is a table wherein colors are represented in the sRGB color system and in the CMYKlclmCL color system and both the systems are in correspondence with each other. Further, in the LUT 15*b*, the correspondence is described with respect to a plurality of colors. Therefore, with respect to an arbitrary color represented in the sRGB color system, the color in the CMYKlclmCL color system corresponding to the arbitrary color can be computed, and color conversion can be carried out. This computation is carried out by referring to colors in sRGB around the arbitrary color, defined in the LUT 15*b*, and performing interpolation.

The LUT 15*b* in this embodiment is generated as follows: with respect to a plurality of colors obtained by combining C, M, Y, K, lc, lm, and CL inks, patches are printed, and the colors of the patches are measured to define the correspondence between the colors and colors in the RGB color system. In the present invention, this constitution is non indispensable. More specific description will be given. With the constitution wherein clear ink is recorded together with colored ink during printing, the present invention only has to be capable of carrying out the following: the recording rate for clear ink is gradually reduced in a range in which the ink recording rate exceeds a predetermined value; or the ratio of the CL ink to a predetermined standard is varied with respect to ink droplets different in discharge quantity. Therefore, the following constitution may be adopted for the LUT: the correspondence is defined between the CMYKlclm color system excluding the CL ink and the sRGB color system, and the ink recording rate is computed from the CMYKlclm data obtained by color conversion. Further, the CL ink is added according to each ink recording rate.

The color conversion module 21*b* carries out the above-mentioned color conversion at Step 110 and Step 120. At Step 110, the module 21*b* acquires the LUT 15*b* from the HDD 15, and at Step 120, it carries out color conversion by interpolation referring to the LUT 15*b*. More specific description will be given. In the image data indicating the image of an object to be printed, the color of each pixel is represented in the sRGB color system. Therefore, the module 21*b* refers to the LUT and extracts colors present around the color of each pixel, and carries out interpolation to convert the color of each pixel into a color represented in the CMYKlclmCL color system.

The CMYKlclmCL data created by color conversion is gradation data with respect to each color component, and corresponds to the ink recording rate for each color component. As described later, the LUT 15*b* is generated so that the CL ink is not excessively added to colored inks at high ink recording rate (high gradation). Therefore, by referring to the LUT 15*b*, color conversion can be carried out so that the quantity of the CL ink is not excessive.

Different LUTs may be prepared beforehand for each printing medium or resolution though description of this constitution is omitted in this specification. Therefore, the following constitution may be adopted: at Step 110, the printing medium or resolution is grasped by data indicating print mode, printing conditions, and the like, and then a corresponding LUT is selected. The half tone processing module 21*c* is a module which carries out half tone processing. Half tone processing is carried out to convert the gradation value of each pixel represented in the CMYKlclmCL color system so that the gradation values are represented by the recording density of ink droplet. At Step 130, the module 21*c* performs half tone processing based on this data. That is, whether to charge ink droplets or not is determined with respect to each pixel in the printer 40.

Further, the print data creation module 21*d* receives data obtained by half tone processing, and at Step 140, rearranges the pieces of data in the order of use in the printer 40. At Step 150, the module 21*d* outputs data used in one main pass to the printer 40. More specific description will be given. The printer 40 is equipped with discharge nozzle rows as an ink discharge device, and in the nozzle rows, a plurality of discharge nozzles are arranged in the direction of auxiliary pass. Therefore, pieces of data dissociated from each other by the amount equivalent to several dots in the direction of auxiliary pass are simultaneously used. At Step 140, consequently, the pieces of data are rearranged so that of pieces of data arranged in the direction of main pass, those to be simultaneously used are simultaneously buffered to the printer 40.

At Step 150, the print data creation module 21*d* adds predetermined information, such as the resolution of images, to the data obtained by rearrangement to create print data. Then, the module 21*d* outputs the data to the printer 40 through the I/O 19*b* for USB. At Step 160, it is judged whether the processing has been completed with respect to all the rasters constituting the image. The processing of Step 100 is repeated until it is judged that the processing has been completed with respect to all the rasters. When the processing has been completed with respect to all the rasters, all the data required for forming the image is transmitted to the printer 40, and the image is formed on a printing medium in the printer 40.

Figure 3:
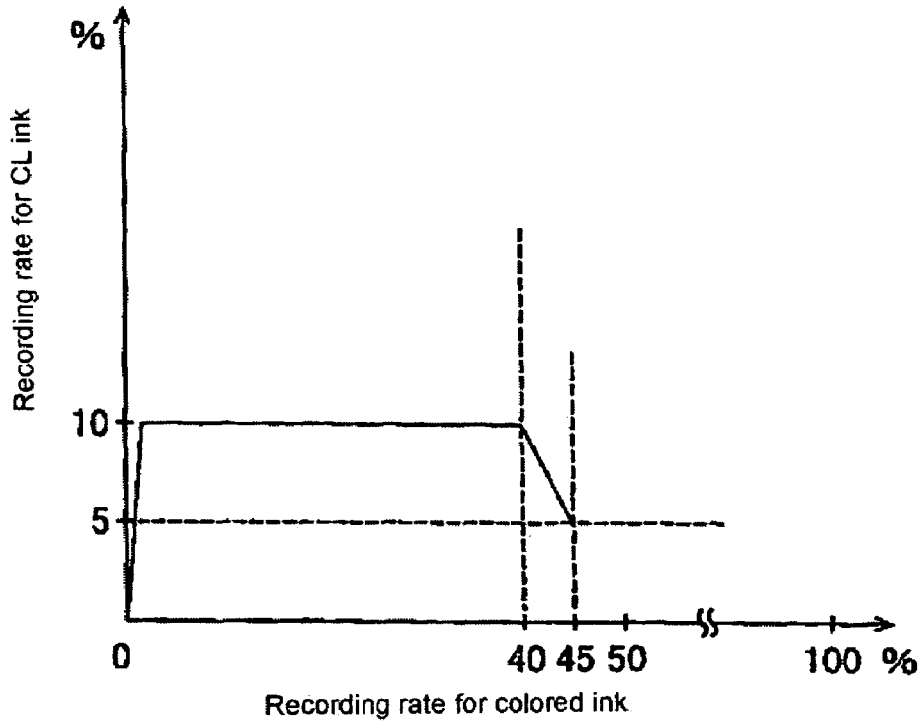
FIG. 3 and FIG. 4 are explanatory drawings of the ink recording rate in a first embodiment.

(1-3) Details of Ink Recording Rate:

In the present invention, the LUT 15*b* is generated so that the CL ink is not excessively added to colored inks at high ink recording rate, as mentioned above. Hereafter, specific description will be given to the way the colorless CL ink is added to colored inks. In this embodiment, the LUT 15*b* is generated so that the total quantity of colored ink and CL ink will not exceed the maximum ink recording rate at which ink can be recorded per unit area of printing media. FIG. 3 is an explanatory drawing illustrating this. Both in FIG. 3 and in FIG. 4, the horizontal axis represents the ink recording rate for the colored ink. In FIG. 3, the vertical axis represents the recording rate for the CL ink, and in FIG. 4 as well, the vertical axis represents the ink recording rate. In this figure, the value of the sum of the recording rate for the CL ink and the recording rate for the colored ink is indicated by thin line, and the recording rate for the colored ink is indicated by heavy line.

Here, the range of value of the recording rate for each color ink is 0 to 100%, and is in one-to-one correspondence with the range of gradation value (0 to 255) in the CMYKlclmCL data for each color. More specific description will be given. The gradation value of each color is converted by the above-mentioned half tone processing so that dots are discharged at the ink recording rate per unit area corresponding to the magnitude of gradation value. Therefore, the ink recording rate for each color can be evaluated from the gradation value of each color defined in the LUT 15*b*. Consequently, if the CL ink is solely evaluated with respect to the ink recording rate obtained from the gradation value of C, M, Y, K, lc, lm, and CL defined in the LUT 15*b*, the recording rate for the CL ink is obtained. If the C, M, Y, K, lc, and lm inks are added in consideration, the recording rate for the colored ink is obtained. If the C, M, Y, K, lc, lm, and CL inks are added in consideration, the value of the sum of the recording rate for the CL ink and the recording rate for the colored ink is obtained.

However, the horizontal axis in FIG. 3 is standardized with a state in which ink is recorded at an ink recording rate of 100% with respect to all the ink colors taken as 100%. In this embodiment, the maximum ink recording rate at which ink can be recorded per unit area of printing media is 50% on the standardized scale. If this 50% is exceeded, undulation in printing media, blotting of ink, worsening of grainy appearance, or banding can occur. With respect to colored ink, the range in which colors can be rendered, ranging from a state in which no ink is recorded on a printing medium to a state in which ink is recorded on a printing medium to the maximum, is determined. Recording as much ink as possible enlarges the color gamut, and the gradation property is enhanced.

With respect to colored inks, however, in general, variation in lightness relative to increase in ink recording rate is reduced with increase in the quantity of ink recorded on printing media. Therefore, if the maximum recording rate for the colored ink in the high gradation range is reduced to a value smaller than the maximum ink recording rate at which ink can be recorded per unit area of printing media, no problem arises: the extent of the color gamut is less influenced. In the present invention, consequently, the maximum recording rate for the colored ink in the high gradation range is made lower by 5% than the maximum ink recording rate at which ink can be recorded per unit area of printing media. That is, the maximum recording rate for the colored ink is set to 45%. Even if the recording rate for the colored ink is lowered to this extent, the wide color gamut can be maintained. The heavy line in FIG. 4 illustrates this.

By recording the CL ink in addition to the colored inks for which the wide color gamut is maintained, the color gamut can be further widened. In this embodiment, the CL ink is recorded at a substantially constant ratio in the other ranges than the high ink recording rate range no matter what value the recording rate for the colored ink takes. More specific description will be given. As illustrated in FIG. 3, the recording rate for the CL ink is constant, that is, 10% until the recording rate for the colored ink exceeds the predetermined value, 40%. When the predetermined value is exceeded, the recording rate for the CL ink is gradually reduced, and when the recording rate for the colored ink reaches 45%, the recording rate for the CL ink becomes 5%. Therefore, the recording rate for the CL ink of 5% is added when the recording rate for the colored ink is 45%, the result is 50%. This is matched with the maximum ink recording rate at which ink can be recorded per unit area of printing media.

Figure 4:
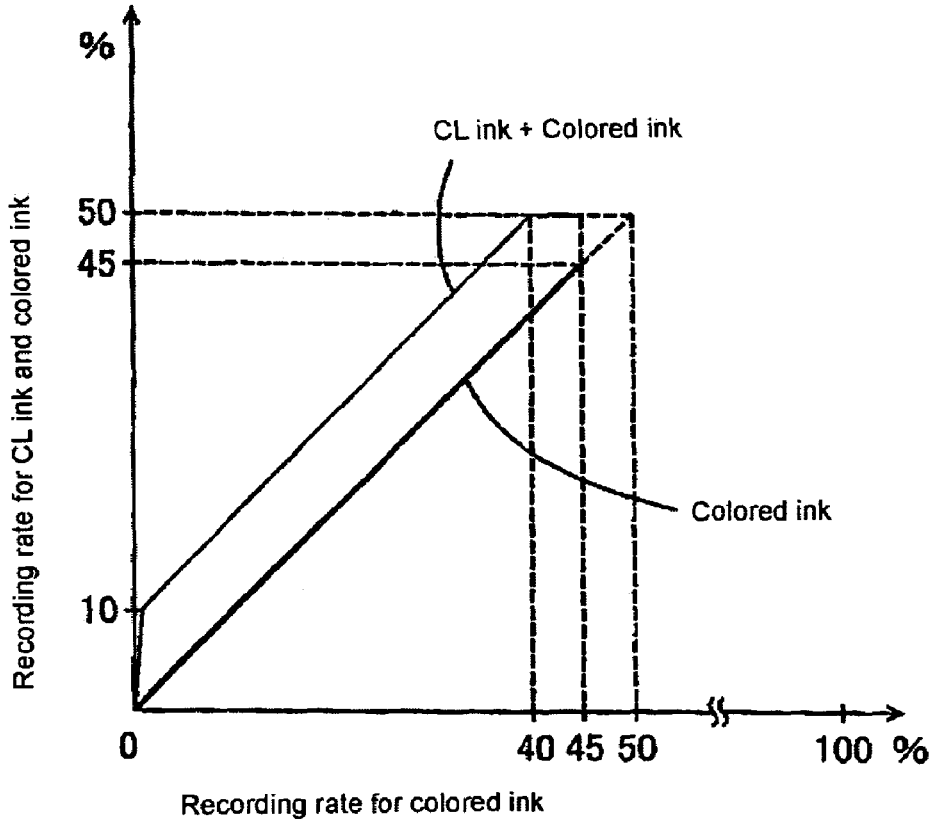

The thin line in FIG. 4 illustrates this. As illustrated in the figure, the sum of the recording rates for the CL ink and colored inks does not exceeds 50% throughout the entire ink recording rate. Thus, undulation in printing media and blotting of ink can be prevented, and further worsening of grainy appearance and banding can be simultaneously prevented. In this embodiment, the CL ink is not recorded when no colored ink is used (when the recording rate for the colored ink is 0). However, various constitutions can be adopted in the ranges other than the range of high ink recording rate (40% or above in FIG. 3) for the prevention of undulation in printing media and blotting of ink. The constitution for this purpose is not limited to that illustrated in FIG. 3.

(2) Details of Ink Recording Rate in Second Embodiment:

As mentioned above, the first embodiment adopts such a constitution that with the discharge quantity of ink droplets constant, the wide color gamut is ensured, and further undulation in printing media and blotting of ink are prevented. In terms of the prevention of undulation in printing media and blotting of ink, there are cases where it is preferable that measures should be taken with respect to different discharge quantities of ink droplets. Consequently, a constitution with consideration given to different discharge quantities of ink droplets will be described as a second embodiment.

There are various constitutions wherein the discharge quantities of ink droplets differ. Examples include cases where the discharge quantity of ink droplet is varied from mode to mode in a single printer, and cases where the default discharge quantity is different between a plurality of printers. The former cases include, for example, cases where the resolution or the type of printing media is different in one and the same unit, and these constitutions can be implemented with the same hardware configuration as illustrated in FIG. 1.

However, the ratio of the CL ink to the colored ink is varied from ink droplet to ink droplet different in discharge quantity. Therefore, LUTs corresponding to the individual ink droplets different in discharge quantity are recorded beforehand on the HDD 15. The print control processing is substantially the same as the processing illustrated in FIG. 2. At Step 110, however, LUT corresponding to the discharge quantity of ink droplets in the printer 40 is selected. Needless to add, this constitution is equivalent to a constitution wherein a different LUT is selected from mode to mode.

Figure 5:
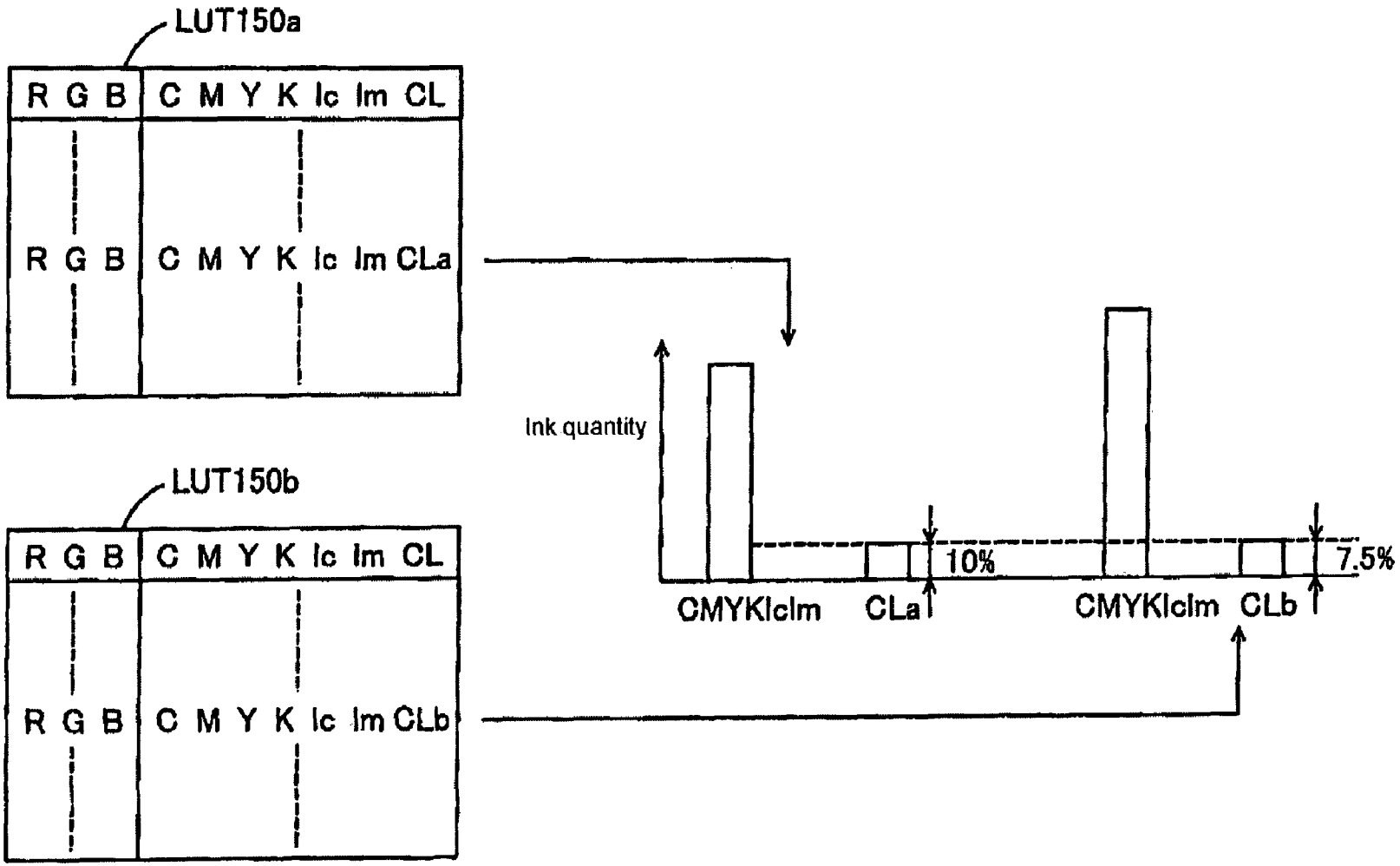
FIG. 5 is an explanatory drawing of LUT and ink quantity in the second embodiment.
Figure 6:
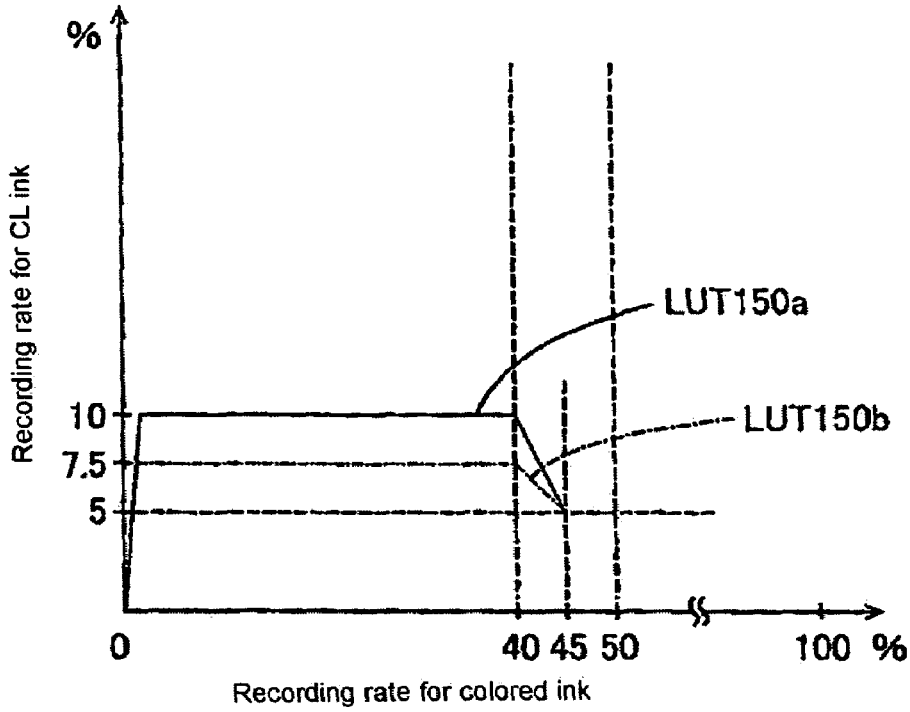
FIG. 6 and FIG. 7 are explanatory drawings of ink recording rate in the second embodiment.
Figure 7:
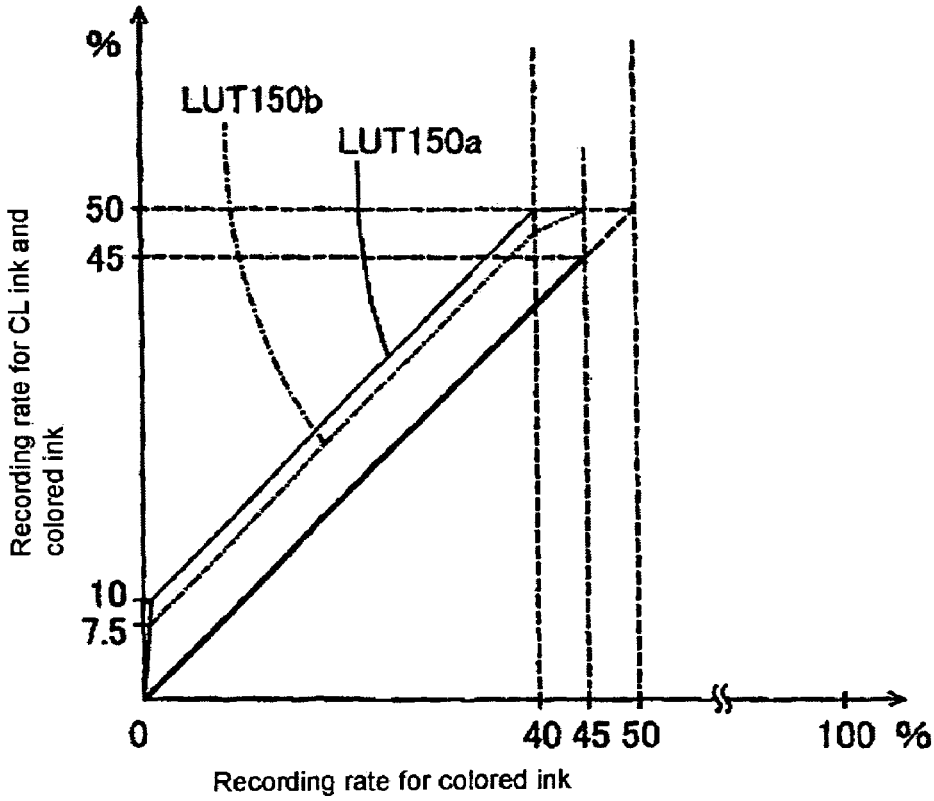

The latter cases include, for example, cases where the discharge quantity of each ink droplet is different from printer model to printer model. The print controller for controlling each printer can be implemented with the same hardware configuration as illustrated in FIG. 1. In each print controller, LUTs corresponding to the discharge quantities of ink droplets in each printer are recorded on the HDD 15. In any case, different LUTs are prepared beforehand for ink droplets different in discharge quantity and recorded on the HDD 15. In FIG. 5 to FIG. 7, these LUTs are indicated as LUT 150*a* and LUT 150*b*.

FIG. 5 is an explanatory drawing illustrating the ink quantities in different LUTs 150*a* and 150*b* with respect to ink droplets different in discharge quantity. FIG. 5 is an explanatory drawing illustrating the ink recording rate in the LUTs 150*a* and 150*b*. As illustrated on the left side of FIG. 5, in the LUTs 150*a* and 150*b*, RGB data and CMYKlclmCL data are in correspondence with each other. In this embodiment, the quantity of the CL ink added is determined by the recording rate for the CL ink as illustrated in FIG. 6. That is, as in FIG. 3, the ink recording rate for the CL ink is substantially constant relative to the ink recording rate for the colored ink in the other ranges than the range of high ink recording rate (40% or above).

However, even if the ink recording rate is substantially constant, the substantially constant value in the LUT 150*a* is different from that in the LUT 150*b*. As illustrated in FIG. 6, the former is 10%, and the latter is 7.5%. The recording rates for the CL ink in the range in which the ink recording rate for the colored ink is high and for a colored ink recording rate of 0 are determined the same as in FIG. 3. That is, when the recording rate for the colored ink is 0, the recording rate for the CL ink is 0 as well. In the range of high ink recording rate, the recording rate for the CL ink is gradually reduced. In this embodiment, as mentioned above, the value of the recording rate for the CL ink is varied from ink droplet to ink droplet different in discharge quantity when the CL ink is added to colored inks. Thus, a favorable quantity of the CL ink can be recorded with respect to each ink droplet.

More specific description will be given. To prevent the grainy appearance from being given and banding from occurring, a maximum ink recording rate (50% in the example illustrated in FIG. 5) at which ink can be recorded per unit area of printing media is given. At this time, undulation in printing media or blotting can occur as the result of addition of the CL ink even if the sum of the recording rates for the CL ink and the colored ink does not exceed this maximum ink recording rate. Further, the recording rate for the CL ink at which undulation in printing media or blotting can occur can differ from discharge quantity to discharge quantity of ink droplets.

With respect to blotting, especially, situations in which various adjustments are required can take place. Addition of the CL ink to the colored ink makes the coloring materials in colored inks prone to coagulate. The degree of blotting differs depending on the relation between two adjoining colors. (For example, blotting is more prominent between black and yellow.) Thus, with respect to ink droplets different in discharge quantity, addition of the CL ink at an identical ratio is not always sufficient. To cope with this, the value of the recording rate for the CL ink is varied from discharge quantity to discharge quantity of ink droplets. Thus, a favorable quantity of the CL ink can be added with respect to each discharge quantity, and undulation in printing media and blotting can be prevented.

On the right side of FIG. 5, the ink quantities recorded according to the gradation values defined in the LUTs 150*a* and 150*b* are respectively shown with respect to the colored ink and the CL ink. This example illustrates a case where the gradation values of the colored inks are identical in the LUT 150*a* and in the LUT 150*b* and the ink recording rates obtained by half tone processing are also identical. Though the ink recording rates for the colored inks are identical, the discharge quantity of ink droplets is different between the LUT 150*a* and the LUT 150*b*. Therefore, the discharge quantities of the colored inks are different.

In this embodiment, while the gradation values of the colored inks are identical, the gradation value of the CL ink take different values CLa and CLb. As a result, the recording rate for the CL ink takes different values (respectively, 10% and 7.5%). Since the values of the recording rate for the CL ink are different, arbitrary CL ink quantities can be set, respectively. However, this embodiment is so constituted that both the ink quantities are substantially identical. This indicates that there is a case. In this case, recording the predetermined CL ink in an absolute quantity is more appropriate, rather than recording the CL ink so that its ratio is constant to the quantities of colored inks discharged in respective colors.

Thus, with respect to ink droplets different in discharge quantity, undulation in printing media and blotting of ink can be prevented, and further worsening of grainy appearance and banding can be simultaneously prevented. Needless to add, it is not required to strictly equalize the ink quantities of the CL ink. If substantially the same ink quantity is set for ink droplets different in discharge quantity, it is preferable that a difference within ±1% should be tolerated, and fine adjustment should be further carried out.

(3) Modifications to First and Second Embodiments

The above-mentioned embodiments adopt the various constitutions. For example, the gradation value of the CL ink defined in LUT is adjusted, and the ink recording rate for the CL ink is thereby adjusted. Thus, the sum of the recording rates for the colored ink and the CL ink becomes a value which does not exceed the maximum ink recording rate at which ink can be recorded per unit area of printing media. Or, the value of the ratio of the CL ink to the colored ink is varied with respect to ink droplets different in discharge quantity. Needless to add, other constitutions may be adopted. For example, the present invention can also be implemented by adjusting the force exerted on inks when the inks are discharged in a printer.

Figure 8:
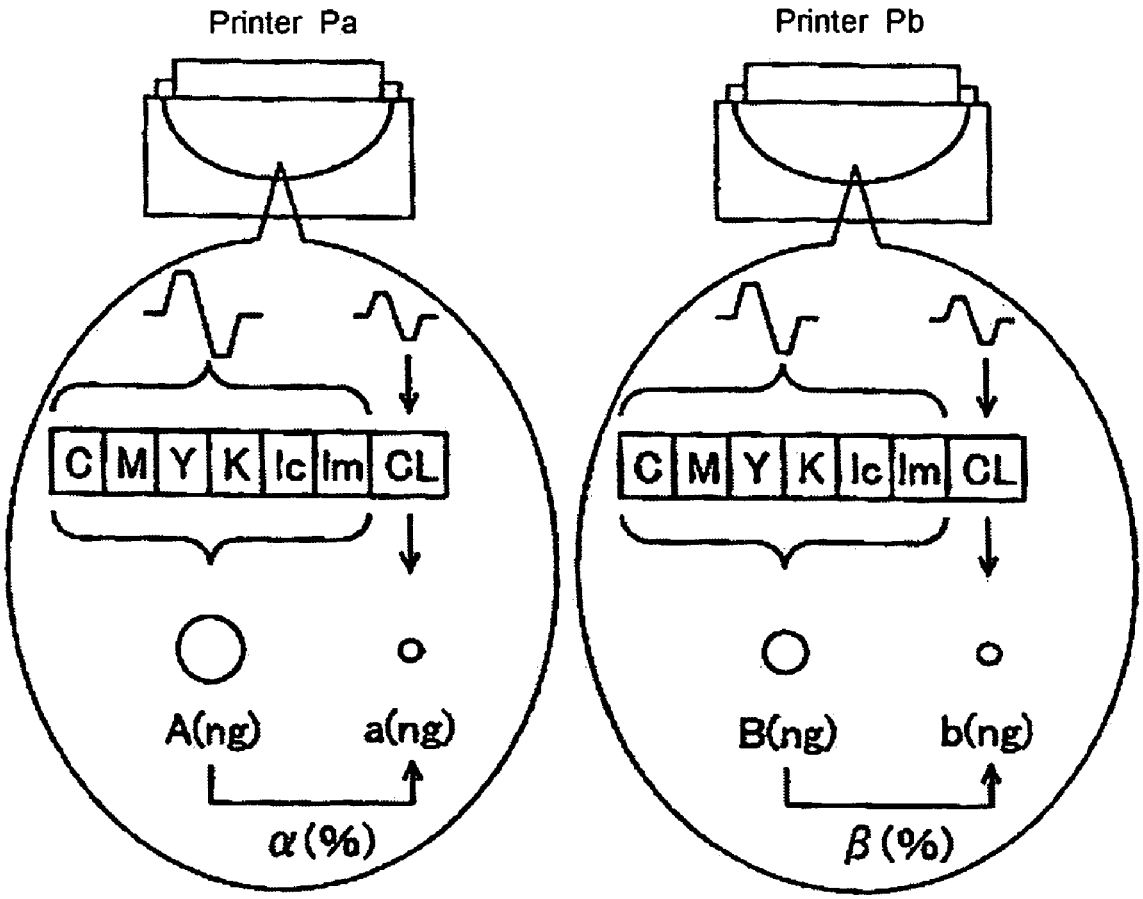
FIG. 8 is an explanatory drawing of ink quantity in another embodiment.

FIG. 8 illustrates such an example. In this example, the printers Pa and Pb are so designed that voltage is applied to piezo elements and ink droplets are thereby discharged. In the printers Pa and Pb, the discharge quantities of ink droplets are different. The figure schematically illustrates heads for discharging inks in C, M, Y, K, lc, lm, and CL, using rectangles. As illustrated in the figure, when predetermined voltage waveform is applied to the piezo elements in the heads for discharging the C, M, Y, K, lc, and lm colored inks, the printers operate as follows: the printer Pa discharges each colored ink by A (ng), and the printer Pb discharges each colored ink by B (ng). In the example illustrated in the figure, A>B.

In the example illustrated in the figure, the voltage applied to the piezo elements in the heads for discharging the CL ink is adjusted as follows: in the printer Pa, the applied voltage is adjusted so that the ratio of the discharge quantity of the CL ink to the discharge quantity A of the colored inks is $\alpha$%. In the printer Pb, the applied voltage is adjusted so that the ratio of the discharge quantity of the CL ink to the discharge quantity B of the colored inks is $\beta$%. Thus, the printer Pa discharges the CL ink by a (ng), and the printer Pb discharges the CL ink by b (ng). This embodiment is so constituted that these ink discharge quantities a and b are substantially identical.

More specific description will be given. The ratio of the discharge quantity of the CL ink to that of the colored inks is varied so that $\alpha<\beta$. Thereby, the discharge quantity of the CL ink is made substantially identical between constitutions different in the discharge quantity of colored ink. As a result, the discharge quantity of the CL ink can be separately adjusted on the printer Pa and on the printer Pb. Thus, undulation in printing media and blotting of ink can be prevented, and further worsening of grainy appearance and banding can be simultaneously prevented. To accomplish the above-mentioned ink discharge quantities in the printers Pa and Pb, the following procedure can be taken: pieces of data indicating the correspondence between the discharge quantities A and B of the colored inks and the ink quantities a and b are held in the printers or a computer. Or, pieces of data indicating the correspondence between $\alpha$ and $\beta$ are held. Then, when print operation is performed, these pieces of data are referred to, and the discharge quantity of the CL ink is adjusted relative to the discharge quantities A and B of the colored inks.

In the constitution illustrated in FIG. 8 as well, it is not required to strictly equalize the ink quantities of the CL ink, needless to add. If substantially the same ink quantity is set for ink droplets different in discharge quantity, it is preferable that a difference within ±1% should be tolerated, and fine adjustment should be further carried out. Further, the following constitution may be adopted: voltage applied to the piezo elements is adjusted, and thereby the maximum recording rate for the colored inks is lowered to a value smaller than the maximum ink recording rate at which ink can be recorded per unit area of printing media. Then, the CL ink is added with the maximum ink recording rate at which ink can be recorded per unit area of printing media taken as the upper limit. While this is done, the quantity of each ink recorded on the printing media is determined.

As mentioned above, the printers Pa and Pb are so constituted that voltage is applied to piezo elements. The present invention is also applicable to a constitution wherein bubbles are formed in the head to discharge inks. In the above-mentioned constitution, the discharge quantities of ink droplets are different in different printers Pa and Pb. The present invention can be applied to other various constitutions. Examples include a constitution wherein the discharge quantity of ink droplet is varied according to print mode, such as resolution and the type of printing media, in a signal printer; and a constitution wherein it is made possible to discharge large, medium, and small ink droplets with respect to each dot, and thereby the discharge quantity of ink droplet is varied.

Figure 9:
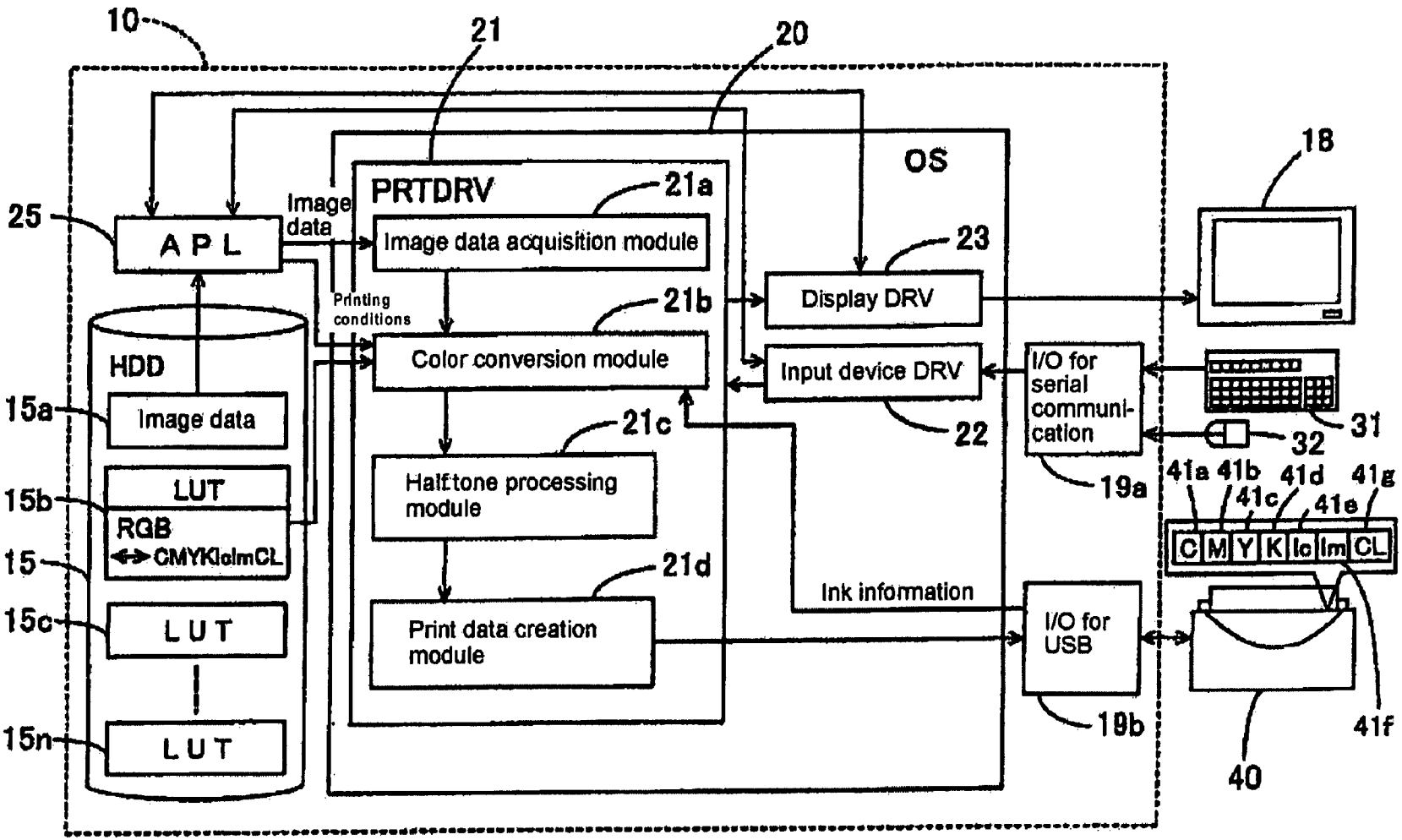
FIG. 9 is a drawing schematically illustrating the configuration of a computer in a third embodiment.

(4) Third Embodiment (4-1) Print Controller:

FIG. 9 is a block diagram schematically illustrating the configuration of a computer as a print controller according to the present invention. Hereafter, description will be given to differences between the computer illustrated in this figure and the computer illustrated in FIG. 1.

When used together with the colored ink, the CL ink is capable of adding gloss to areas which have small quantities of colored inks recorded and are thus less glossy, and of eliminating a difference in gloss and improving the color development.

When the APL 25 provides an instruction to print, the PRTDRV 21 is driven, and the PRTDRV 21 sends data out to the display DRV 23. The display DRV 23 displays UI as mentioned above. At this time, the user operates the keyboard 31, mouse 32, or the like to set the printing conditions required for performing print operation at the UI as the user desires. Possible printing conditions include: print resolution; the type of ink (selection of color or monochrome); the type of printing media; print quality (e.g. beautiful, fast); the type of color management (e.g. the availability of automatic adjustment, the availability of colors beyond the color gamut in the display); and the availability of bi-directional printing.

For printing condition items for which the user does not make setting, the previous values are set as default. When the user sets printing conditions at the UI, the modules of the PRTDRV 21 are started, and print data corresponding to the printing conditions is created, as mentioned above.

Figure 10:
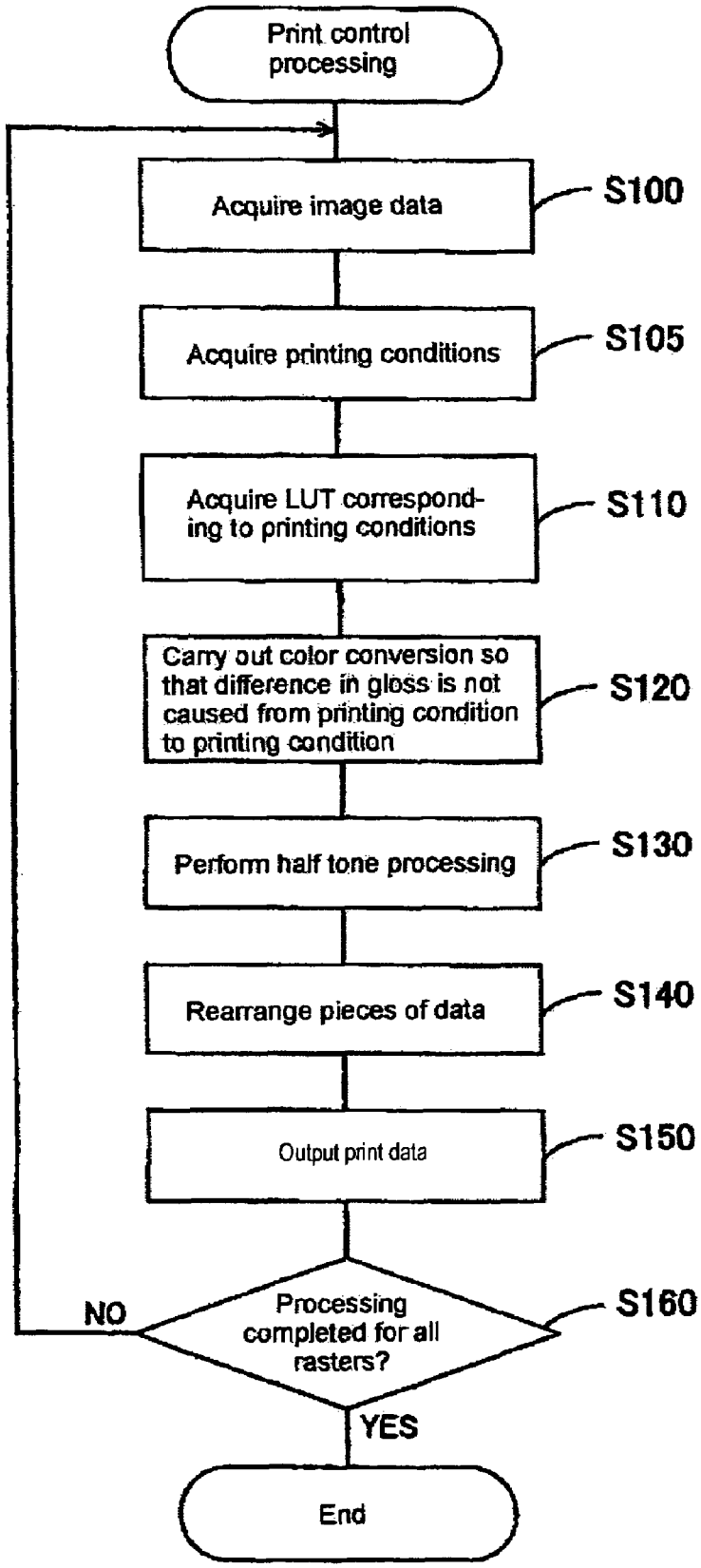
FIG. 10 is a flowchart of print control processing.

(4-2) Print Control Processing:

The PRTDRV 21 performs print control processing in accordance with the flow illustrated in FIG. 10. When the APL 25 reads the image data 15*a* and after retouching or the like, provides an instruction to print, the printing conditions are set and the PRTDRV 21 is started. At Step 100, the image data acquisition module 21*a* acquires the image data 15*a* indicating the image for which the instruction to print is provided by the APL 25. If there is any excess or deficiency in the number of pixels in the image data 15*a* at this time, resolution conversion processing is performed as required to ensure pixels required for the print operation.

The color conversion module 21*b* is a module which converts color systems in which the color of each pixel is indicated. The module 21*b* refers to any of LUTs (color conversion tables) 15*b* to 15*n* recorded on the HDD 15, and carries out color conversion. At this time, the sRGB color system of the image data 15*a* is converted into the CMYKlclmCL color system whose components are the inks (C, M, Y, K, lc, lm, and CL) loaded in the printer 40. In this embodiment, the LUTs 15*b* to 15*n* are tables wherein colors are represented with gradation in the sRGB color system and in the CMYKlclmCL color system and both the systems are in correspondence with each other. Further, in the LUTs 15*b* to 15*n*, the correspondence is described with respect to a plurality of colors. Therefore, with respect to an arbitrary color represented in the sRGB color system, the color in the CMYKlclmCL color system corresponding to the arbitrary color can be computed, and color conversion can be carried out. This computation is carried out by referring to colors in sRGB around the arbitrary color, defined in the LUTs 15*b* to 15*n*, and performing interpolation.

However, a problem arises. The colors in the sRGB color system are uniquely identified by the gradation values of R, G, and B. However, the colors in the CMYKlclmCL color system differ depending on printing conditions even if the gradation values of C, M, Y, K, lc, lm, and CL are identical. To cope with this, LUT is generated with respect to each printing condition, and the generated LUTs 15*b* to 15*n* are recorded beforehand on the HDD 15. Since the LUTs 15*b* to 15*n* are generated beforehand with respect to each printing condition, the following advantage is brought: the quantity of the colorless CL ink can be adjusted from printing condition to printing condition by adjusting the gradation value of CL defined in each LUT. More specifically, even if the gradation values of C, M, Y, K, lc, and lm colored inks are identical, the gradation value of CL differs depending on printing conditions.

More specific description will be given. The quantity of the CL ink is defined at a predetermined ratio determined by the gradation value, and the colored inks are recorded together with the CL ink. With this constitution, print operation can be performed without causing a difference in gloss even if printing conditions are different. It is C, M, Y, K, lc, and lm inks that actually develops colors. However, the color development on printing media varies depending on whether the CL ink is recorded or not. Though the CL ink is colorless, therefore, LUTs are defined as CMYKlclmCL color system with CL included and color conversion is carried out into the system in which CL is included.

The LUTs 15*b* to 15*n* in this embodiment are generated as follow: with respect to a plurality of colors obtained by combining C, M, Y, K, lc, lm, and CL inks, patches are printed, and the colors of the patches are measured to define the correspondence between the colors and colors in the RGB color system. In the present invention, this constitution is not indispensable. More specific description will be given. With the constitution wherein the CL ink is recorded together with the colored ink, the present invention only has to be capable of varying the ratio of the CL ink to a predetermined standard from printing condition to printing condition. Therefore, the following constitution may be adopted for the LUTs: the correspondence between the CMYKlclm color system excluding the CL ink and the sRGB color system is defined, and the ink recording rate is computed from the CMYKlclm data obtained by color conversion. Further, the CL ink is added according to each ink recording rate.

In any case, the LUTs 15*b* to 15*n* corresponding to printing conditions are recorded on the HDD 15. At Step 105, the color conversion module 21*b* acquires the printing conditions set at the UI. At Step 110, the module 21*b* selects and acquires the LUT corresponding to the printing conditions from among the LUTs 15*b* to 15*n*, and at Step 120, it carries out color conversion by interpolation referring to the LUT. More specific description will be given. In the image data indicating the image of an object to be printed, the color of each pixel is represented in the sRGB color system. Therefore, the module 21*b* refers to the LUT and extracts colors present around the color of each pixel, and carries out interpolation to convert the color of each pixel into a color represented in the CMYKlclmCL color system.

The CMYKlclmCL data created by color conversion is gradation data with respect to each color component, and corresponds to the ink recording rate for each color component. As described later, the LUTs 15*b* to 15*n* are generated so that a difference in gloss is not caused from printing condition to printing condition. Therefore, by carrying out color conversion referring to the relevant LUT, print operation can be performed so that a difference in gloss is not caused from printing condition to printing condition.

The half tone processing module 21*c* and the print data creation module 21*d* are the same as those mentioned above. At Step 130, half tone processing is carried out, and at Step 140, pieces of data are rearranged in the order of use in the printer 40. At Step 150, data used in one main pass is outputted to the printer 40. At Step 160, it is judged whether the processing has been completed with respect to all the rasters constituting the image. The processing of Step 100 is repeated until it is judged that the processing has been completed with respect to all the rasters.

Figure 11:
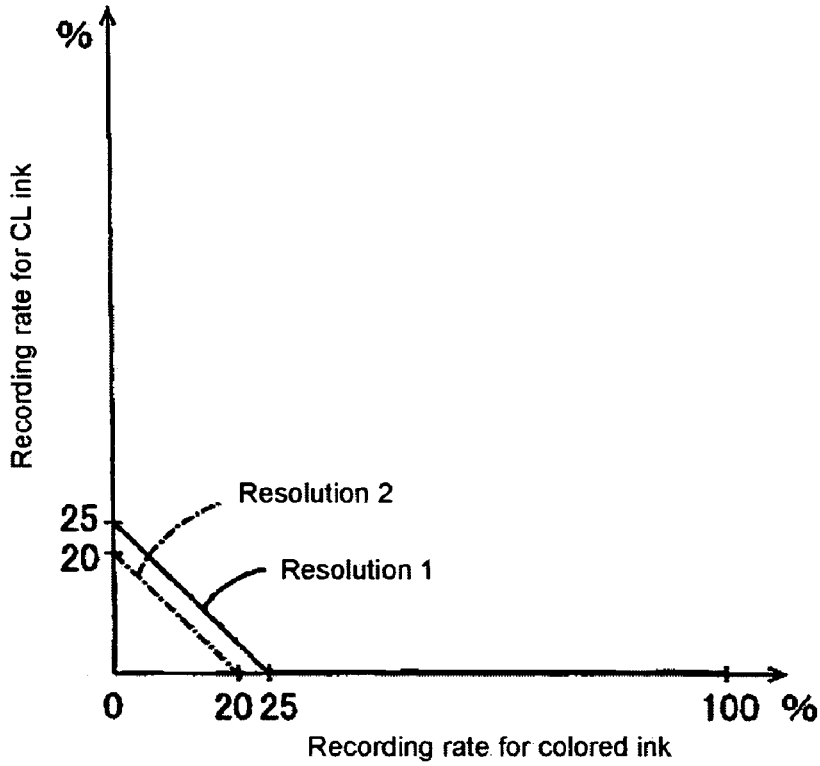
FIG. 11 and FIG. 12 are explanatory drawings of ink recording rate in the third embodiment.
Figure 12:
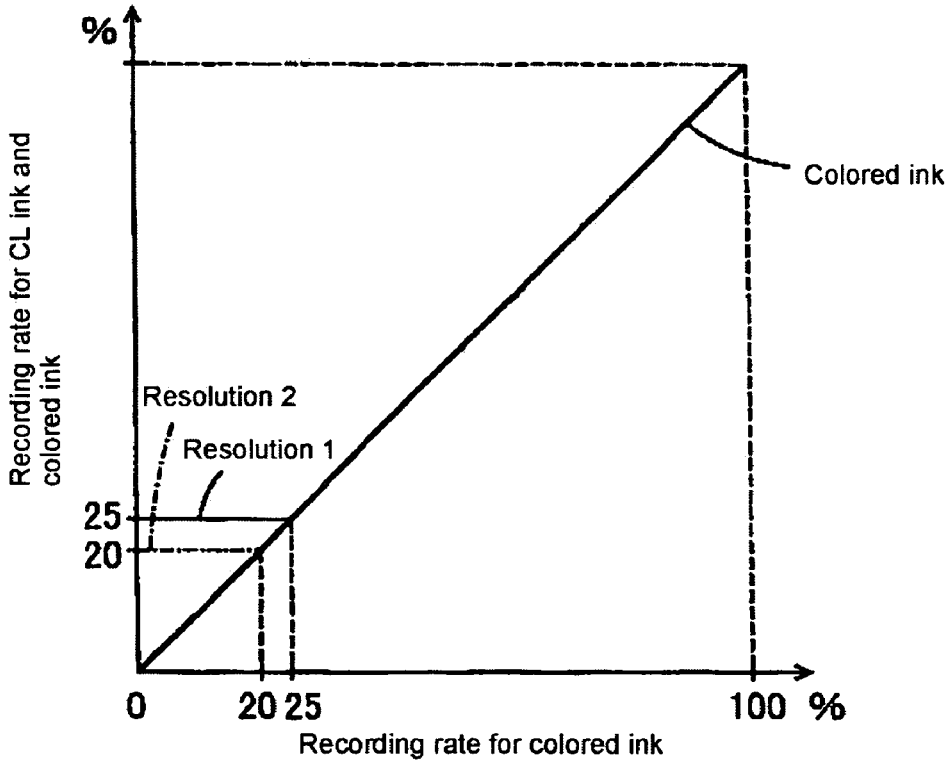

(4-3) Details of Ink Recording Rate:

In the present invention, different LUTs 15*b* to 15*n* are utilized depending on printing conditions, as mentioned above. Thereby, the quantity of the CL ink is defined at a different predetermined ratio from printing condition to printing condition, and the CL ink is recorded together with the colored inks. This embodiment is so constituted that a difference in gloss is eliminated especially between the area of low ink recording rate and the area of high ink record ingrate. Hereafter, specific description will be given to the way the colorless CL ink is recorded together with the colored inks. FIG. 11 and FIG. 12 are explanatory drawings illustrating the ink recording rate obtained by referring to different LUTs when the resolution as one of printing conditions differs.

Both in FIG. 11 and in FIG. 12, the horizontal axis represents the ink recording rate for the colored ink. In FIG. 11, the vertical axis represents the recording rate for the CL ink, and in FIG. 12 as well, the vertical axis represents the ink recording rate. In this figure, the value of the sum of the recording rate for the CL ink and the recording rate for the colored ink is indicated by thin line and alternate long and short dash line, and the recording rate for the colored ink is indicated by heavy line. Here, the range of value of the recording rate for each color ink is 0 to 100%, and is in one-to-one correspondence with the range of gradation value (0 to 255) in the CMYKlclmCL data for each color. More specific description will be given. The gradation value of each color is converted by the above-mentioned half tone processing so that dots are discharged at the ink recording rate per unit area corresponding to the magnitude of gradation value. Therefore, the ink recording rate for each color can be evaluated from the gradation value of each color defined in the LUTs.

Consequently, if the CL ink is solely evaluated with respect to the ink recording rate obtained from the gradation value of C, M, Y, K, lc, lm, and CL defined in the LUTs, the recording rate for the CL ink is obtained. If the C, M, Y, K, lc, and lm inks are added in consideration, the recording rate for the colored ink is obtained. If the C, M, Y, K, lc, lm, and CL inks are added in consideration, the value of the sum of the recording rate for the CL ink and the recording rate for the colored ink is obtained. However, the horizontal axis in FIG. 11 is standardized with 100% taken for the maximum ink recording rate at which ink can be recorded per unit area of printing media. If this 100% is exceeded, undulation in printing media, blotting of ink, worsening of grainy appearance, or banding occurs.

In this embodiment, the LUTs are generated so that a difference in gloss is eliminated between the area in which the recording rate for the colored ink is low and that in which the recording rate is high under the same printing conditions. At the same time, the LUTs are generated so that a difference in gloss is not caused even under different printing conditions. FIG. 11 illustrates the ink recording rates obtained by carrying out color conversion referring to the thus generated LUTs and performing half tone processing. The figure illustrates the ink recording rates with respect to two different resolutions: 1440×720 dpi (Resolution 1) and 2880×1440 dpi (Resolution 2).

First, description will be given to the way a difference in gloss is eliminated between the area of low colored ink recording rate and the area of high colored ink recording rate with the respective resolutions. In the area on a printing medium where the recording rate for the colored ink is low, the ink quantity is smaller than in the area of high ink recording rate. Thus, the area of low recording rate is less glossy. When the ink quantity reaches some level, gloss is not increased with increase in ink quantity but becomes less dependent on ink quantity. Therefore, when the recording rate for the colored ink is equal to or below a predetermined value, the CL ink is recorded. Thereby, gloss can be given and a difference in gloss can be eliminated without having great influence on colors of low ink recording rate.

Consequently, this embodiment adopts the following constitution: when the recording rate for the colored ink is between "0" and a predetermined value, the recording rate for the CL ink is gradually reduced with increase in the recording rate for the colored ink. While this is done, the CL ink is added to the colored ink. When the recording rate for the colored ink is equal to or above the predetermined value, the recording rate for the CL ink is set to "0." Further, in the range of value in which the recording rate for the colored ink is equal to or below the predetermined value, the sum of the recording rate for the colored ink and the recording rate for the CL ink is made substantially identical. More specific description will be given. As illustrated in FIG. 11, in the LUT referred to in print operation with Resolution 1, the recording rate for the CL ink is set to 25% when the recording rate for the colored ink is "0." The recording rate for the CL ink is linearly and gradually reduced toward a point at which the recording rate for the colored ink becomes 25%.

For this reason, as illustrated in FIG. 12, the recording rate for the CL ink is gradually reduced with linear increase in colored ink recording rate until the colored ink recording rate reaches 25%. While this is done, the CL ink is added to the colored ink, and the sum of the recording rates for both is constant at 25%. In this embodiment, when the ink recording rate of 25% is exceeded with Resolution 1, no great difference in gloss is caused even if the ink recording rate is further increased. Therefore, by adding the CL ink as mentioned above, a difference in gloss can be eliminated between the area in which the recording rate for the colored ink is low and the area in which the recording rate is high.

The present invention is so constituted that a difference in gloss due to a difference in the recording rate for the colored ink is prevented, as mentioned above. At the same time, the present invention is also constituted so that a difference in gloss is prevented from being caused even under the same printing conditions. More specific description will be given. With Resolution 2 in this example, when the ink recording rate of 20% is exceeded, a great difference in gloss is not caused even if the ink recording rate is further increased. Therefore, the ink recording rate required for eliminating a difference in gloss with Resolution 2 is different from that with Resolution 1.

Consequently, in the LUT referred to in print operation with Resolution 2, the recording rate for the CL ink is set to 20% when the recording rate for the colored ink is "0," as illustrated in FIG. 11. The recording rate for the CL ink is linearly and gradually reduced toward a point at which the recording rate for the colored ink reaches 20%. As a result, as illustrated in FIG. 12, the sum of the recording rates for the colored ink and the CL ink is constant at 20% until the colored ink recording rate reaches 20%. With Resolution 2 as well, a difference in gloss can be eliminated between the area in which the recording rate for the colored ink is high and the area in which the recording rate is low. Further, in this embodiment, the gloss obtained at the ink recording rate of 25% with Resolution 1 is substantially identical with the gloss obtained at the CL ink recording rate of 20% with Resolution 2. Therefore, a difference in gloss from resolution to resolution can be eliminated.

In print operation with the same image data, a difference in the gloss of printed matter can be caused due to difference in print resolution. In this embodiment, this difference in gloss is eliminated by changing LUTs from resolution to resolution. Under different printing conditions, in general, a difference in gloss can be caused due to various complicated factors. Hereafter, description will be given to factors which can cause a difference in gloss. With respect the two different resolutions mentioned above, Resolution 2 is higher in definition than Resolution 1. It will be assumed that the ink recording rate at which ink is recorded per unit area (the number of dots recorded per unit area) is identical. If the ink discharge quantity per pixel is made identical between different resolutions in this case, the quantity of ink recorded per unit area significantly differs. To cope with this, usually, the ink discharge quantity per pixel is varied.

This embodiment adopts the similar constitution. The definition of Resolution 2 is two times that of Resolution 1; therefore, the ink discharge quantity per pixel of the latter is reduced to approximately ½ of that of the former. In this example, if the resolution as a printing condition differs, the ink discharge quantity per pixel differs as well. Further, if the ink discharge quantity per pixel differs, the degree of spread of ink on a printing medium differs when the ink adheres to the medium. That is, if the ink discharge quantity per pixel differs, the spread on a medium and the ink discharge quantity are not always in proportion to each other, and the spread differs. This is because the ink droplets are different in diameter, and thus a difference in surface tension and viscosity have an influence.

As mentioned above, in the following case, the ink quantity on media and the appearance of ink on media differ even if print operation is performed according to the same image data: a case where the print resolution differs and the ink discharge quantity per pixel and the spread of ink on media differ. Therefore, if the ratio which defines the quantity of the CL ink is identical, gloss differs from printing condition to printing condition.

To eliminate a different between printing conditions, this embodiment is so constituted that a different LUT is referred to on a resolution-by-resolution basis. With respect to a plurality of colors obtained by combining C, M, Y, K, lc, lm, and CL inks, patches are printed with individual resolutions. Thereafter, the patches are compared for a difference in gloss from resolution to resolution. Then, LUTs wherein the CL ink is added so as to prevent a difference in gloss due to resolution are generated. As a result, print operation can be performed without causing a difference in gloss from resolution to resolution.

Even if with different resolutions, the ink discharge quantity per pixel is identical, the following case can occur: when the predetermined ratio which defines the quantity of the CL ink is made identical between resolutions, the gloss differs from resolution to resolution. Needless to add, the present invention can be applied to this case. As mentioned above, resolutions can be compared with one another when LUTs are generated. Therefore, even if the cause of a difference in gloss from resolution to resolution cannot be analyzed, the difference in gloss between resolutions can be eliminated in the event.

As an example of another case, it will be assumed that a difference in gloss is caused when the resolution is identical and the ink discharge quantity per pixel differs. In this case, the difference in gloss can be eliminated by the following procedure: the above-mentioned patches are printed with different ink discharge quantities per pixel, and a different LUT is generated with respect to each ink discharge quantity. More specific description will be given. When the resolution is doubled as mentioned above, reducing the ink discharge quantity to ½ is not indispensable. The ink discharge quantity can take various values in relation with other various conditions. Therefore, the difference in gloss can be eliminated by taking complicated printing conditions into account and generating LUT with respect to each printing condition. Similarly, there is a case where even if the resolution and the ink discharge quantity per pixel are identical, the spread of ink on media differs. Possible cases include a case where the type of printing media or the type of ink is different.

In this case as well, the difference in gloss can be eliminated by the following procedure: the above-mentioned patches are printed with the spread of ink on media being different, and different LUTs are generated in accordance with differences in the spread of ink. More specific description will be given. There are various printing conditions, and gloss differs from printing condition to printing condition due to complicated factors based on differences in conditions. In any case, a difference in gloss between printing conditions can be eliminated by varying the value of the predetermined ratio at which the CL ink is added. If printing conditions are different and yet there is no difference in gloss, different LUTs need not be generated, needless to add.

(5) Modification to Third Embodiment

The above-mentioned embodiment is so constituted that: the gradation value of the CL ink defined in LUT is adjusted from printing condition to printing condition, and thereby the ink recording rate for the CL ink is adjusted. At the same time, the sum of the recording rate for the colored ink and the CL ink is made substantially constant in a predetermined range of value of colored ink recording rate. Needless to add, other constitutions may be adopted. For example, the present invention can be implemented also by adjusting the force exerted on inks in a printer when the inks are discharged. Data indicating such CL ink recording rates as illustrated in FIG. 11 is held in the printer or a computer. Then, when print operation is performed, the recording rate for the colored ink is acquired, and piezo elements are driven so that the corresponding CL ink recording rate is obtained.

Figure 13:
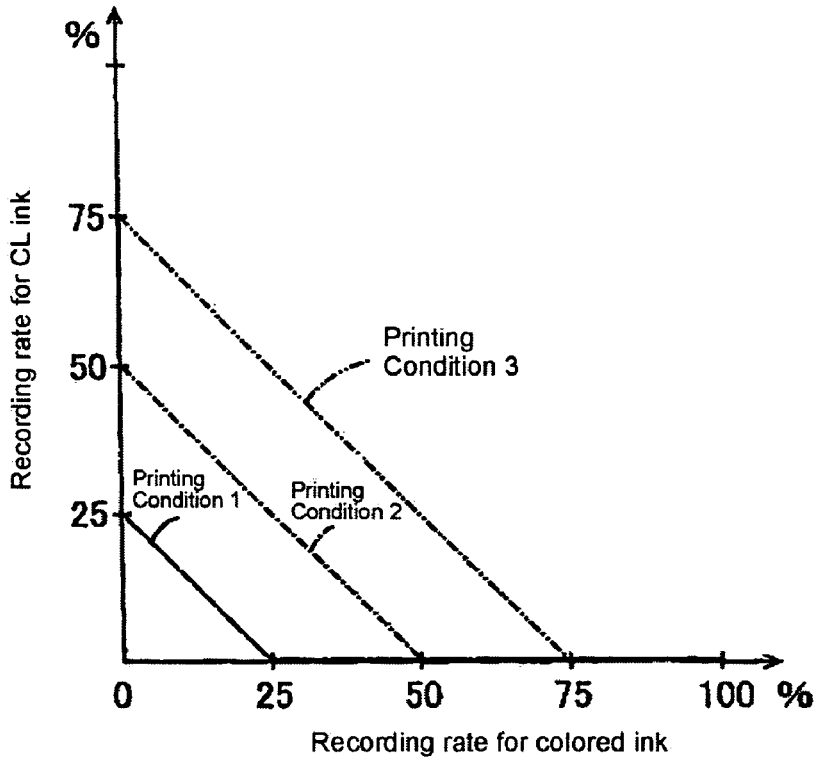
FIG. 13 and FIG. 14 are explanatory drawings of LUT and ink quantity in a modification to the third embodiment.
Figure 14:
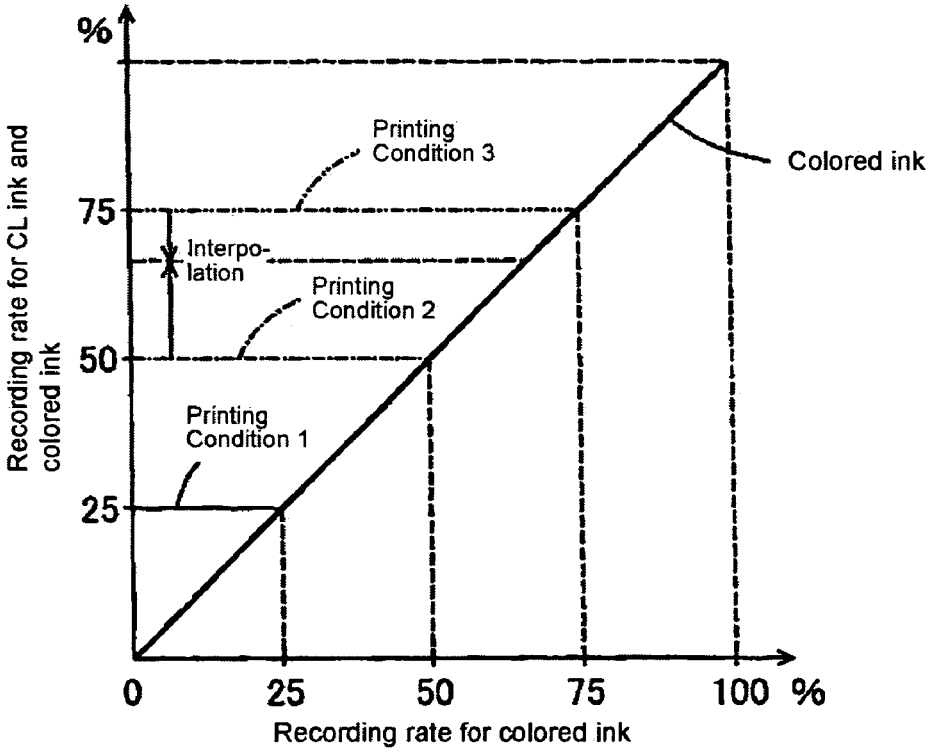

Further, the present invention may be applied to a constitution wherein bubbles are formed in a head and thereby inks are discharged. Further, the following constitution may be adopted: when printing conditions differ from printer to printer, the ratio of the CL ink is varied from printing condition to printing condition. Setting the recording rate for the CL ink with respect to each printing condition as illustrated in FIG. 11 is not indispensable. For example, the clear ink recording rate may be set as illustrated in FIG. 13 and FIG. 14. In this example, under different printing conditions, Printing Conditions 1 to 3, the value of the CL ink recording rate is significantly changed for the colored ink recording rate of "0."

FIG. 14 illustrates the result. As illustrated in the figure, under Printing Condition 1, the sum of the recording rates for the colored ink and the CL ink is 25% when the recording rate for the colored ink is not more than 25%. Under Printing Condition 2, the sum of the recording rates for the colored ink and the CL ink is 50% when the recording rate for the colored ink is not more than 50%. Under Printing Condition 3, the sum of the recording rates for the colored ink and the CL ink is 75% when the recording rate for the colored ink is not more than 75%. With this constitution, a difference in gloss between printing conditions can be eliminated even if the ink recording rate largely contributes to gloss.

If the values of set items for printing conditions can be changed in a trend, for example, if the resolution can be changed continuously or discretely within a certain range, the following results: a plurality of printing conditions exist and a different in gloss between them is increased. Therefore, the present invention can be favorably applied to this case. If it is desired to reduce the work of generating a large number of LUTs in advance or resources for recording them, another constitution may be adopted, needless to add: a plurality of LUTs are generated in advance, and the CL ink recording rate under printing conditions between them is computed by interpolation.

The above-mentioned embodiment is so constituted that the sum of the recording rates for the colored ink and the CL ink is kept substantially constant against variation in colored ink recording rate. However, this constitution is not indispensable. More specific description will be given. A different in gloss between printing conditions is caused by various complicated factors. Therefore, the rate of change at which the CL ink recording rate is gradually reduced may be increased, or the CL ink recording rate may be gradually increased. Thus, gloss can be more finely adjusted with respect to each printing condition, and a difference in gloss between printing conditions can be eliminated with higher reliability.

Figure 15:
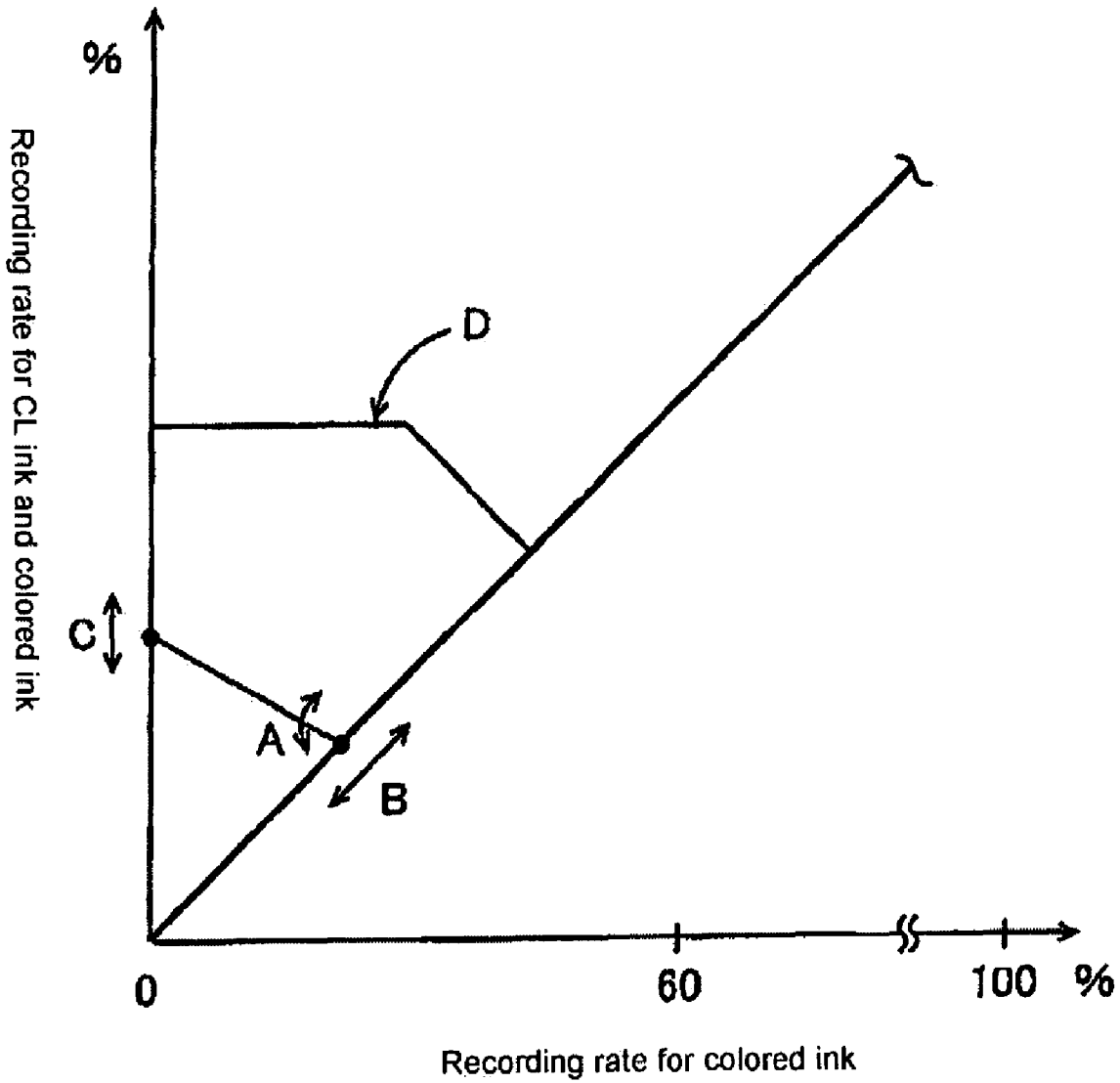
FIG. 15 is an explanatory drawing of LUT and ink quantity in a modification to the third embodiment.

FIG. 15 illustrates an example of such constitutions. By adjusting the rate of change in CL ink recording rate, the gradient of the CL ink recording rate can be adjusted as indicated by arrow A. Further, the value to which the recording rate for the CL ink is limited can be increased or decreased and adjusted as indicated by arrow B. Or, the CL ink recording rate with that for the colored ink being "0" can be increased or decreased and adjusted as indicated by arrow C. If the gloss is determined by the total quantity of inks recorded on a printing medium, it is preferable that the adjustment indicated by arrow B should be made. If the ink quantity or the spread of ink on a printing medium differs at the same ink recording rate, it is preferable that the adjustment indicated by arrow C should be made.

Further, linearly varying the CL ink recording rate is not indispensable. That is, the rate of change in the CL ink recording rate relative to the recording rate for the colored ink need not be constant. By varying the rate of change, the sum of the recording rates for the colored ink and the CL ink may be crooked on a graph, as indicated by arrow D in FIG. 15. Or, the sum of the recording rates for the colored ink and the CL ink may be curvedly varied. Thus, the gloss can be finely adjusted on a printing condition-by-printing condition basis, and a difference in gloss between printing conditions can be eliminated with higher reliability. Needless to add, the rate of change in CL ink recording rate may be discrete, and, for example, the value of CL ink recording rate may be finite when the colored ink recording rate is "0." The horizontal axes and the vertical axes in FIG. 13 and FIG. 14 are the same as the horizontal axes and the vertical axes in FIG. 11 and FIG. 12. The horizontal axis and the vertical axis in the FIG. 15 are also the same as the horizontal axes and the vertical axes in FIG. 11 and FIG. 12.

We claim:

1. A print controller which controls a printing device so designed that ink droplets of colored inks containing coloring materials and a clear ink containing no coloring material are discharged onto a printing medium and an image is thereby formed, the print controller comprising:

an ink quantity determining unit which when quantities of inks are determined so that said colored inks and said clear ink are recorded on said printing medium, varies a value of a predetermined ratio which indicates a quantity of said clear ink relative to a predetermined standard for ink droplets having different discharge quantities, and determines the quantities of said inks to be recorded such that the quantity of said clear ink is made substantially identical for ink droplets having different discharge quantities; and a print operation performing unit which drives said printing device so as to form an image with the ink quantities determined by said ink quantity determining unit, wherein said ink quantity determining unit makes said predetermined ratio for ink droplets large in discharge quantity lower than that for ink droplets smaller in discharge quantity, and wherein a maximum recording rate for said colored ink is less than a maximum ink recording rate at which ink can be recorded per unit area of printing media, and clear ink is recorded while preventing the maximum recording rate from being exceeded.

2. A print controller which controls a printing device so designed that ink droplets of colored inks containing coloring materials and a clear ink containing no coloring material are discharged onto a printing medium and an image is thereby formed, the print controller comprising:

an ink quantity determining unit which when quantities of inks are determined so that said colored inks and said clear ink are recorded on said printing medium, varies a value of a predetermined ratio which indicates a quantity of said clear ink relative to a predetermined standard for ink droplets having different discharge quantities, and determines the quantities of said inks to be recorded such that the quantity of said clear ink is made substantially identical for ink droplets having different discharge quantities; and a print operation performing unit which drives said printing device so as to form an image with the ink quantities determined by said ink quantity determining unit, wherein said ink quantity determining unit makes an inverse of the discharge quantity of each ink droplet substantially equal to a ratio of said predetermined ratio which indicates the quantity of said clear ink relative to said predetermined standard for ink droplets having different discharge quantities, and wherein a maximum recording rate for said colored ink is less than a maximum ink recording rate at which ink can be recorded per unit area of printing media, and clear ink is recorded while preventing the maximum recording rate from being exceeded.

3. A print controller which controls a printing device so designed that ink droplets of colored inks containing coloring materials and a clear ink containing no coloring material are discharged onto a printing medium and an image is thereby formed, the print controller comprising:

an ink quantity determining unit which when quantities of inks are determined so that said colored inks and said clear ink are recorded on said printing medium, varies a value of a predetermined ratio which indicates a quantity of said clear ink relative to a predetermined standard for ink droplets having different discharge quantities, and determines the quantities of said inks to be recorded such that the quantity of said clear ink is made substantially identical for ink droplets having different discharge quantities; and a print operation performing unit which drives said printing device so as to form an image with the ink quantities determined by said ink quantity determining unit, wherein said ink quantity determining unit makes said predetermined ratio for ink droplets large in discharge quantity lower than that for ink droplets smaller in discharge quantity, and wherein said ink quantity determining unit makes an inverse of the discharge quantity of each ink droplet substantially equal to a ratio of said predetermined ratio which indicates the quantity of said clear ink relative to said predetermined standard with respect to ink droplets different in discharge quantity, and wherein a maximum recording rate for said colored ink is less than a maximum ink recording rate at which ink can be recorded per unit area of printing media, and clear ink is recorded while preventing the maximum recording rate from being exceeded.

* * * * *